US006109897A

United States Patent [19]

Haga

[11] Patent Number: 6,109,897

[45] Date of Patent: Aug. 29, 2000

[54] SCROLL FLUID MACHINE HAVING A COOLING PASSAGE INSIDE THE DRIVE SHAFT

[75] Inventor: Shuji Haga, Yokohama, Japan

[73] Assignee: Anest Iwata Corporation, Tokyo, Japan

[21] Appl. No.: 09/161,387

[22] Filed: Sep. 28, 1998

Related U.S. Application Data

[62] Division of application No. 08/757,683, Nov. 29, 1996, Pat. No. 5,842,843.

[30] Foreign Application Priority Data

Nov. 30, 1995 [JP] Japan ..... 7-334342

[51] Int. Cl.[7] ..... F01C 1/04; F01C 21/06

[52] U.S. Cl. ..... 418/55.1; 418/55.2; 418/60; 418/94; 418/101

[58] Field of Search ..... 418/55.1, 55.2, 418/60, 94, 101; 165/86 H, 104.26, DIG. 139, DIG. 156

[56] References Cited

U.S. PATENT DOCUMENTS

| | | | |
|---|---|---|---|
| 3,842,596 | 10/1974 | Gray | 165/86 H |
| 4,014,631 | 3/1977 | Goloff | 418/94 |
| 4,473,343 | 9/1984 | Hazaki et al. | 418/94 |
| 5,024,589 | 6/1991 | Jetzer et al. | 418/94 |
| 5,101,888 | 4/1992 | Sprouse et al. | 165/104.26 |
| 5,346,374 | 9/1994 | Guttinger | 418/55.2 |
| 5,417,554 | 5/1995 | Kietzman et al. | 418/55.2 |

FOREIGN PATENT DOCUMENTS

| | | | |
|---|---|---|---|
| 61-200391 | 9/1986 | Japan | 418/94 |
| 1267382 | 10/1989 | Japan | 418/101 |

*Primary Examiner*—John J. Vrablik
*Attorney, Agent, or Firm*—Evenson, McKeown, Edwards & Lenahan, P.L.L.C.

[57] ABSTRACT

A scroll fluid machine is disclosed, which comprises a stationary scroll with an embedded wrap which is spiral in form, extending from a central part of a scroll body toward the outer periphery thereof, and a revolving scroll with an embedded spiral wrap engaging with said spiral wrap, the said revolving scroll having a scroll body coupled to a drive shaft 11A coupled to a drive at the central portion thereof. The drive shaft 11A is cooled directly by cooing means provided inside it. The scroll body of the revolving scroll has a central part coupled to a drive. Heat generated in a process, in which fluid sucked from the scroll edge is led to the central part while being progressively compressed, can be removed at the central part which is elevated to a highest temperature, thus permitting efficient cooling of bearings and seal members near the revolving scroll central part and the drive shaft.

6 Claims, 17 Drawing Sheets

SCROLL FLUID MACHINE HAVING A COOLING PASSAGE INSIDE THE DRIVE SHAFT

CROSS REFERENCE TO RELATED APPLICATION

This application is a division of application Ser. No. 08/757,683, filed Nov. 29, 1996, now U.S. Pat. No. 5,842,843.

BACKGROUND OF THE INVENTION

1. Field of the Invention

This invention relates to a scroll fluid machine, in which sucked fluid is compressed with stationary and revolving scrolls and discharged to the outside.

2. Description of the Related Art

A scroll fluid machine compresses fluid sucked from its peripheral part in a sealed space formed by its stationary and revolving scrolls progressively as the fluid is fed toward its central part, and discharges the compressed fluid from the central part. As the fluid is compressed, the temperature in the sealed space formed by the wraps is elevated. This poses a problem that bearings, seal members, etc. provided in drive parts are soon deteriorated. Heretofore, the scrolls are cooled to hold the temperature within a predetermined temperature.

Well-known cooling systems cool either a non-driven part, i.e., the stationary scroll, or a driven part, i.e., the revolving scroll.

FIG. 16 shows a technique concerning a non-driven part cooling system. As shown, a revolving scroll 116 which is mounted on a frame 109 provided in a sealed housing 105, comprises a disc-like body 114 having a shaft 113 depending therefrom. The frame 109 has a central hole, in which a drive shaft 104 coupled to a drive (not shown) is fitted for rotation, and the shaft 113 is eccentrically coupled to the drive shaft 104. The revolving scroll 116 has a wrap 115 engaging with a wrap 111 of a stationary scroll 112.

The stationary scroll 112 has a peripheral wall having a suction hole 118. When the revolving scroll 116 is revolved relative to the stationary scroll 112 with the rotation of the drive shaft 104, a sealed space formed by the wraps 111 and 115 is progressively reduced in volume, thus compressing gas entering the sealed space. The compressed gas is discharged from a discharge hole 121 formed in a central part of the stationary scroll 112 through a discharge pipe 120 to the outside.

A plurality of radially spaced-apart heat pipes 122 are provided in the body 110 of the stationary scroll 112 to remove heat generated in a compression stroke as described above.

FIG. 17 shows a well-known cooling a system for cooling a driven part, i.e., the revolving scroll.

A housing 211 as shown comprises a rear and a front housing part 212 and 213, and a drive shaft 214 is supported for rotation by bearings 215 in a bearing portion of the rear housing part 212. The drive shaft 214 has an extension projecting outward from the bearing portion and coupled to a motor (not shown). The drive shaft 214 also has an eccentric portion 214*b*, which has an eccentric axis 02—02 with respect to the axis 01—01 of the drive shaft 214 by a distance δ.

A revolving scroll 216 which is coupled to the eccentric portion 214*b* of the drive shaft 214, has a disc-like plate 216*a* having a mirror finished front surface, a spiral wrap 216*b* formed on the front side of the mirror finished plate 216*a*, a boss 216*c* formed as the driving center with an axial line 02—02 on the rear side of the plate 216*a* and having smaller diameter than the inner peripheral surface edge of above portion 213*b*, a ring-like ridge 216*d* formed on the rear side of the above plate 216*a* and on the periphery thereof, and a plurality of radial vent holes 216*e* formed in a diameter direction above the ridge 216*d*.

A stationary scroll 221, which is secured to the front housing part 213, has a disc-like plate 221*a* having a mirror finished rear surface, a spiral wrap 221*b* formed on the rear side of the plate 211*a* and a peripheral wall 221*c* surrounding the wrap 221*b*.

The wraps 216*b* and 221*b* of the revolving and stationary scrolls 216 and 221 engage with or wrap each other at a predetermined deviation angle, and they form a plurality of compression chambers or spaces when the revolving scroll 216 is revolved.

The drive shaft 214 has a counterweight 225 mounted on its portion extending in the rear housing part 212, and a centrifugal fan 226 is mounted on the counterweight 225 to generate cooling air flow with the rotation of the drive shaft 214.

In the prior art non-driven part cooling system shown in FIG. 16, in which the heat pipes 122 are provided in the stationary scroll body, the heat absorbing portions of the heat pipes 122 are more remote from the revolving scroll which is driven than from the stationary scroll. Therefore, the neighborhood of the bearings, seal members and other parts which are driven in contact with the revolving scroll 116 in the driving thereof, is cooled less efficiently compared to the cooling of the stationary scroll. This means that uniform temperature distribution cannot be obtained.

The heat radiating portions of the heat pipes 122 are cooled by their heat radiation to the sealed housing inner space 105*a*, which is filled with gas sucked through a suction pipe 119.

In communication with the space 105*a* is the suction hole 118, through which gas enters the compression space which is formed by the stationary and revolving scrolls. This means that gas having been elevated in temperature by the heat radiation from the heat pipes 122 again enters the compression space through the suction hole 118, thus reducing the cooling efficiency.

In order to prevent the cooling efficiency reduction, it is necessary to provide special cooling means on an external part to which the suction pipe 119 is connected, thus complicating the construction and increasing the size of the apparatus.

In the well-known driven part cooling system shown in FIG. 17, with the rotation of the drive shaft 214 external gas is sucked through a suction passage 227 by the centrifugal fan 226 and led through a ring-like space B and a cooling air passage 220 to be discharged through a discharge passage 228.

Since in this system the gas having cooled down a central part of the revolving scroll 216 is discharged along the rear side of the revolving scroll 216 and through the discharge passage 228, the provision of the discharge passage is necessary. In addition, in order to increase the cooling efficiency, a cooling fan for cooling the rear side of the stationary scroll 221 has to be provided, thus increasing the size of the apparatus.

OBJECT AND SUMMARY OF THE INVENTION

The invention was made in view of the affairs discussed above, and it has an object of providing a scroll fluid machine with an improved cooling efficiency.

Another object of the invention is to provide a scroll fluid machine with improved durability.

A further object of the invention is to provide a scroll fluid machine which is reduced in size.

According to the invention, in a scroll fluid machine comprising stationary scrolls each having a wrap embedded spirally in a scroll body such as to extend from a central part toward the outer periphery of the scroll body, and a revolving scroll having spiral wraps embedded in a scroll body and engaging with the spiral wraps of the stationary scrolls, the revolving scroll being coupled to a drive shaft coupled to a drive, it is featured that cooling means is provided in the drive shaft.

With this construction according to the invention, the drive shaft can be cooled directly. Since the revolving scroll is driven by the drive shaft coupled to the drive, it is possible to cool heat generated in a process, in which fluid sucked from the edge of the scroll is led to a central part thereof while being progressively compressed. It is thus possible to obtain efficient cooling of bearings and seal members provided around the revolving scroll and also those provided around the drive shaft.

It is also possible to eliminate the thermal expansion difference between the stationary scrolls and the revolving scroll, provide a uniform temperature distribution, prevent scoring of the wraps, extend the grease maintenance cycle and improve the durability.

It is further possible to reduce heat generation for reducing the scroll clearance, increasing the operation speed and increasing the attainable pressure.

Suitably, the drive shaft is formed with a hollow cooling passage for introducing cooling gas from one end and discharging the same from the other end in it.

Suitably, turbulent flow forming means is provided in the cooling passage to stir the introduced cooling gas.

It is thus possible to provide gas cooling means with a simple construction. Besides, by providing the turbulent flow forming means the gas temperature difference between an edge part of the cooling passage adjacent the surface thereof and a central part thereof can be quickly reduced, thus obtaining an improved cooling efficiency.

More suitably, a fan is provided at one end of the drive shaft while providing at the other end of the cooling passage with radial communication holes toward the outer periphery of the above drive shaft, thus causing gas having contributed to the cooling by the fun to be compulsively exhausted through the communication holes to cool the drive shaft.

Specifically, the revolving scroll 3 (FIG. 5) is cooled by cooling gas 32 passing through the cooling passage 11A*d* (FIG. 1) or 11B*d* (FIG. 2), and the gas that has contributed to the cooling is exhausted by the fan 13 through the communication holes 11A*c* (FIG. 1) or 11B*c* (FIG. 2).

It is further suitable to form the drive shaft to be hollow and provide heat transfer means therein.

As shown in FIG. 3, heat pipes 24A and 24B may be provided in an axially formed hollow passage 11C*d* in a drive shaft 11C.

As shown in FIG. 4, each of the heat pipes 24A and 24B has a sealed pipe-like vessel 25 made of such material as copper, stainless steel, nickel, tungsten, molybdenum, etc., a wick structure 28 disposed in the vessel 25, an inner space 25*d* defined by the wick structure 28 and operating fluid re-circulated between the wick structure and the inner space while being gasified and liquified by heating and cooling. In an evaporating zone 25*a*, the operating fluid is gasified by receiving heat from the revolving scroll to be transferred to condensing zone 25*c* as shown by arrow 37. In the condensing zone 25*c*, it releases heat and is liquified again to return to the wick structure 28.

The heat pipes 24A and 24B can transfer heat a great deal, specifically several hundred times compared to such metals as copper and aluminum which are good heat conductors, thus it is possible to get a efficient cooling of revolving scroll.

It is further suitable to provide a fan at an end of the drive shaft for cooling the heat radiating part of the heat transfer means.

The heat transfer means may be provided in the hollow drive shaft such that its heat absorbing zone and heat radiating zone are inclined with respect to the axis of rotation of the drive shaft. Particularly, it may be provided such that the heat absorbing zone is located in an eccentric portion of the shaft and the heat radiating portion is located in a portion other than the eccentric portion. With this arrangement, a centrifugal force generated by the rotation of the drive shaft has an effect of forcing the operating fluid having been liquified in the condensing zone 25*c* (FIG. 4) to the heating zone, thus promoting the re-circulation of the operating fluid and improving the cooling efficiency.

According to the invention it is effective, in a scroll fluid machine comprising stationary scrolls having a wrap embedded spirally in a scroll body such as to extend from a central part toward the outer periphery of the scroll body, and a revolving scroll having spiral wraps embedded in a scroll body and engaging with the spiral wraps of the stationary scrolls, said the revolving scroll being coupled to a drive shaft coupled to a drive at the central portion of the scroll body, to drive the eccentric portion of the drive shaft for cooling the shaft.

The revolving scroll thus has a central part of its body driven by the drive shaft coupled to the drive, and heat generated in the process, in which fluid sucked from the edge of the scroll is led to a central part thereof while being progressively compressed, can be removed in the central part which is at the highest temperature. Thus, parts provided in the neighborhood of the central part of the revolving scroll can be cooled efficiently.

According to the invention it is further effective to provide a fan at one end of the drive shaft, form the drive shaft with a hollow cooling passage for introducing cooling gas from one end and discharging the same from the other end of the drive shaft, and radial communication holes toward the periphery of revolving shaft in the other end of the cooling passage, thereby causing gas having contributed to the cooling by the fun to be compulsively exhausted through the communication holes to cool the central part of the revolving scroll, while cooling the other part thereof except above central part with gas not having passed through said communication hole.

With this construction, the central part of the revolving scroll 3 (FIG., 5) is cooled by cooling gas 32 passing through the cooling passage 11A*d* (FIG. 1) or 11B*d* (FIG. 2), and the gas having contributed to the cooling is compulsively exhausted by the fan 13 through the communication holes 11A*c* (FIG. 1) or 11B*c* (FIG. 2).

The fan 13 further exhausts gas that has cooled the rear side of the housing part 4 (FIG. 5), i.e., the stationary scroll, with the warp 7 embedded therein, in the directions of arrows 40 in FIG. 8.

Thus, not only the central part of revolving scroll but also other parts can be cooled, that is, efficient cooling can be obtained.

According to the invention it is further effective to provide a fan on an end of said drive shaft, said heat transfer means being able to cool a central part of said revolving scroll, said fan being able to cool said revolving scroll inclusive of the heat radiating zones of the heat transfer means or said stationary scrolls on the side thereof opposite the wraps side.

In this case, the fans (FIG. 3) produce cooling air flows in the directions of arrows 35 and 36 to cool the heat radiating zones (i.e., condensing zones).

Where the double-wrap revolving scroll with wraps embedded in opposite side surfaces of the scroll body is combined with the stationary scrolls, the fans 12 and 13 produce cooling air flows in the directions of arrows 39 and 40 (FIG. 8) to cool the heat pipes, while exhausting gas having cooled the stationary scrolls constituted by the housing parts 4 and 5 on the side thereof opposite the wraps.

The invention is further applicable to scroll fluid machine comprising a single-wrap revolving scroll with a single wrap embedded in one side surface of the scroll body and a single stationary scroll. In this case, either the stationary scroll or the revolving scroll may be located near a fan for exhausting gas having cooled the heat pipes and the stationary or revolving scroll on the side thereof opposite the wrap.

DETAILED DESCRIPTION OF THE PREFERRED EMBODIMENTS

Preferred embodiments of the invention will now be described. It is to be construed that unless particularly noted the sizes, materials, shapes and relative dispositions shown in the embodiments have no sense of limiting the scope of the invention but are merely exemplary.

The basic scroll fluid machine construction adopting a shaft cooling system embodying the invention will now be described.

Figure 5:
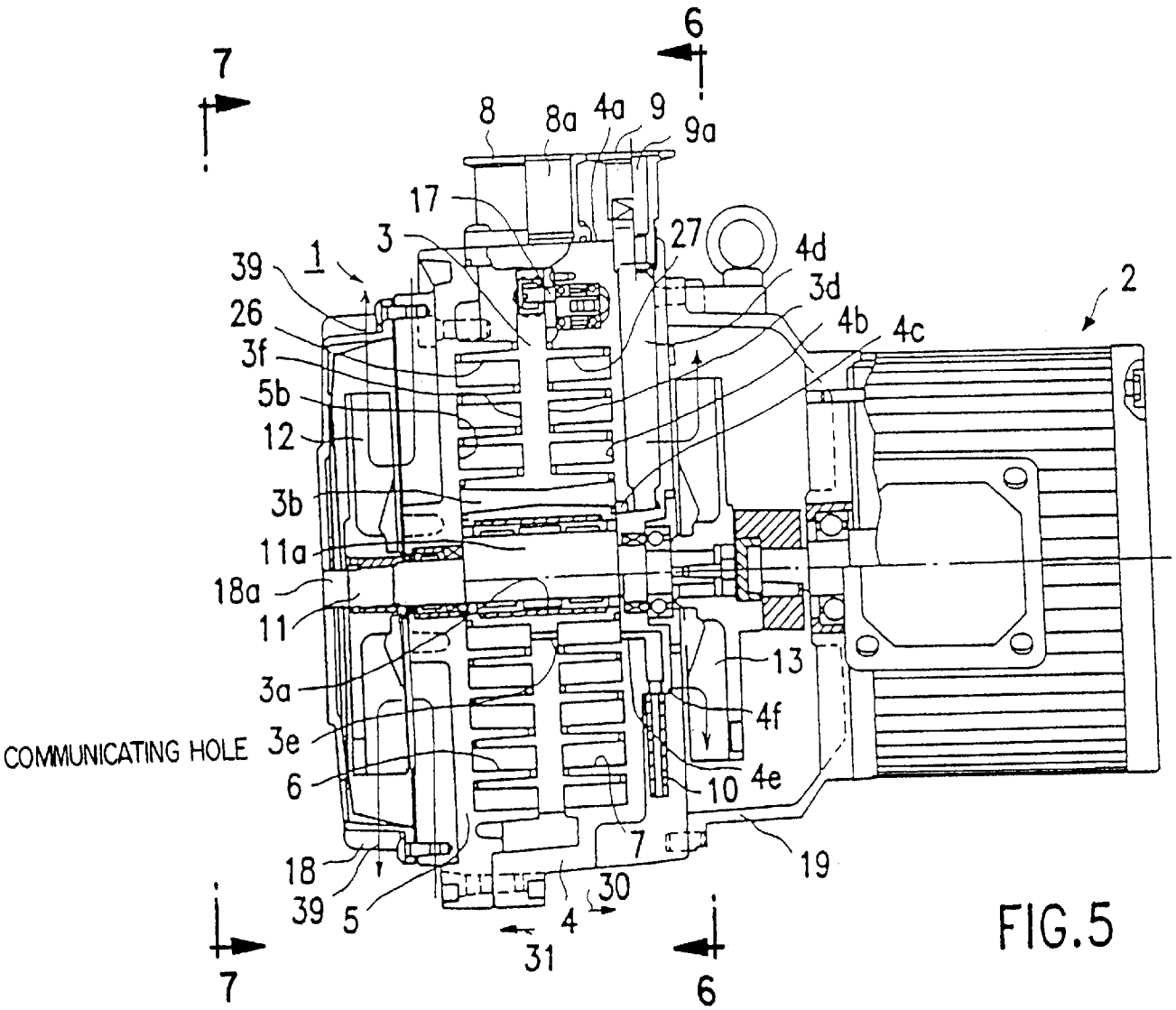
FIG. 5 is a view showing a scroll fluid machine embodying the invention.

FIG. 5 shows a pump 1 having a shaft 11, which is coupled at its right end to a drive shaft of a motor 2 for being rotated by the torque thereof.

The shaft 11 has a central eccentric portion 11*a* having some swelling part to rotating central axial line of outer peripheral, which the both edge side of a eccentric portion 11*a* are driven to be supported for rotation in bearings and packing sections in housing parts 4 and 5.

The housing parts 4 and 5 are cap-like in shape and constitute respective stationary scrolls. Their peripheral walls are sealed together via an intervening seal member to define a sealed inner space.

The housing part 4 has a wrap sliding surface 4*b* perpendicular to its axis and also has a hole 4*i* (see FIG. 8), which is formed in a central portion of the wrap sliding surface 4*b*, and in which the end portion of the shaft 11, adjacent the eccentric portion 11*a* and not eccentric, is fitted for rotation. The housing part 4 has a wrap 7 embedded in it. The wrap 7 (see FIGS. 9(*a*) and 9(*b*)) is spiral clockwise when viewed in the direction of arrow 30 and has an end 7*a* located in the neighborhood of the hole 4*i*. The wrap 7 has a tip groove formed in its tip or outer edge. A tip seal 14 is fitted in the tip groove. The tip seal 14 is made of a fluorine type resin or the like and is self-lubricating to provide perfect seal with the associated rubbing surface in contact with it (see FIG. 8).

The housing part 4 further has a discharge hole 4*c* (see FIGS. 8, 9), which is open in the wrap rubbing surface 4*b* in the neighborhood of the end 7*a* of the wrap 7. Compressed gas is discharged through the discharge hole 4*c* through a discharge passage 4*d* from a discharge port 9 formed in the peripheral wall 4*a* of the housing part 4 to the outside.

The side of the housing part 4 opposite the wrap 7 constitutes a scroll body 4*f* which is provided with a suction pipe 10 for ballast gas introduction. Gas is sucked from the suction pipe 10 through a suction passage 4*g* (see FIG. 8) and suction hole 4*e* into a sealed space R.

Three revolving mechanism sets 17 are mounted on the peripheral wall 4*a* of the housing part 4 on 3 spots by 120° in the peripheral direction.

These revolving mechanism sets 17 are coupled to a revolving scroll to be described later.

A peripheral port 4*a* of housing 4 has an absorbing port 8 coupled to a vessel to be evacuated (not shown), at where the gas is sucked through the hole 8*a* from above vessel.

The other housing part 5 likewise has a wrap sliding surface 5*b* perpendicular to its axis, as well as a hole formed in a central portion of the wrap sliding surface 5*b*, the end portion of the shaft 11 adjacent the eccentric portion 11*a* and not eccentric being fitted for rotation in the hole. A wrap 6 which is spiral counterclockwise when viewed in the direction of arrow 31, is also embedded in the housing part 5, and has an end located in the neighborhood of the hole. The wrap 6 has a tip groove formed on its tip, and a tip seal 14 (FIG. 8) is fitted in the tip groove and provides a perfect seal with the associated rubbing surface in contact with it.

A revolving scroll 3 is disposed for revolving in the inner space defined in the housing parts 4 and 5.

The revolving scroll 3 is disc-like in shape and has opposite side wrap rubbing surfaces 3*d* and 3*f* with wraps 26 and 27 embedded thereon for engaging with the stationary scroll wraps.

The wrap 26 is spiral clockwise when viewed in the direction of arrow 30, and the opposite side wrap 27 is spiral counterclockwise when viewed in the direction of arrow 31.

The revolving scroll 3 has a central hole 3*a*, in which the eccentric portion 11*a* of the shaft 11 is fitted for rotation. The central hole 3*a* is surrounded by ring-like wrap ends 26*a* and 27*a* of the wraps 26 and 27 over the entire length of the eccentric portion 11*a*.

The wrap ends 26*a* and 26*b* communicate with a passage 3*b* leading to the discharge hole 4*c*, and a final compression space defined by the wraps 26 and 6 is communicated by a hole 3*g* with the passage 3*b*.

A sealed space R which is defined by the stationary scroll wrap 7 and the revolving scroll wrap 27 for introducing ballast gas, and a sealed space L defined by the stationary scroll wrap 6 and the revolving scroll wrap 26, are communicated with each other by a communicating hole 3*e*. Gas entering from the suction pipe 10 is led from the sealed space R through the communicating hole 3*e* so as to fill the sealed space L.

Fans 12 and 13 are provided outside of housing 5 and housing 4 on the shaft 11 to cool the vacuum pump and a cover 18 and 19 having a hole 18*a* in the central portion are mounted in housing 5 and 4 in order to protect those fans.

Between the housing part 5 and a cover 18 is mounted a shield 29B (see FIG. 7) having numbers of holes 29B*a* and 29B*b*, and between the housing part 4 and a cover 19 is mounted a shield 29A (see FIG. 6) having numbers of holes 29A*a* and 29A*b*.

The three revolving mechanism sets 17 on three spots separated by 120° in the peripheral direction are supported at one end by housing 4 and at the other end by outer periphery of the revolving scroll, and the revolving scrolls are revolved through above revolving mechanism 17 by an axis eccentric rotating centers with respect to the stationary scrolls.

The operation of the above basic construction according to the invention will now be described with reference to FIGS. 9 to 12. FIGS. 9(*a*) to 12(*a*) are taken along line 9*a*—9*a* in FIG. 8, and FIGS. 9(*b*) to 12(*b*) are taken along line 9*b*—9*b*.

Referring to FIG. 5, when the shaft 11 is rotated, the revolving scroll 3 is revolved to suck gas from a vessel (not shown). The sucked gas is led from the outer peripheries of the stationary scroll wraps by the revolving scroll wraps 26 and 27 into a sealed space defined by these stationary and revolving scroll wraps for compression in the space. While the gas is compressed in three or more sealed spaces, the sealed space is changed from one shown at R0 in FIG., 12(*a*) to one shown at R1 in FIG. 9(*a*), whereupon the suction hole 4*e* of the gas ballast suction pipe 10 is opened.

When the pressure in the vessel to be evacuated is close to the atmospheric pressure, the pressure in the sealed space R1, into which gas is introduced form the suction hole 4*e*, is already higher than the atmospheric pressure. When the pressure of gas introduced from the suction pipe 10 is lower than the pressure in the sealed space R1, no gas is introduced through the suction hole 4*e*.

With the revolving of the revolving scroll 3 the sealed spaces R and L are changed from the states R1 and L1 (FIGS. 9) to states R2 and L2 (FIGS. 10), then states R3 and L3 (FIGS. 11) and then states R4 and L4 (FIGS., 12), whereby the compressed gas is discharged through the discharge hole 4*c*.

When the gas in the vessel contains steam at the instant of the states R1 and L1, the saturated vapor pressure is exceeded in the final seal space states R4 and L4. The steam is thus condensed and liquified into water drops, which are attached to and accumulated on the wrap surfaces defining the final sealed spaces.

When steam is liquified before the states R1 and L1 are reached, slight water drops are caused to flow reversely through the suction hole 4e in the stationary scroll 4 into the suction pipe 10. However, since the suction hole 4*e* is narrow and gas ballast gas is present therein, only very slight water drops are introduced into the suction pipe 10.

As the pressure in the vessel to be evacuated is reduced, liquefaction of steam in the vessel proceeds, but even with compression of the sucked gas before the reaching of the sealed spaces R1 and L1, into which gas is introduced from the gas ballast suction hole 4*e*, the pressure in the sealed spaces R1 and L1 becomes lower than the pressure of the gas to be introduced through the suction hole 4*e*. The gas is thus introduced through the suction hole 4*e*.

Figure 10A:
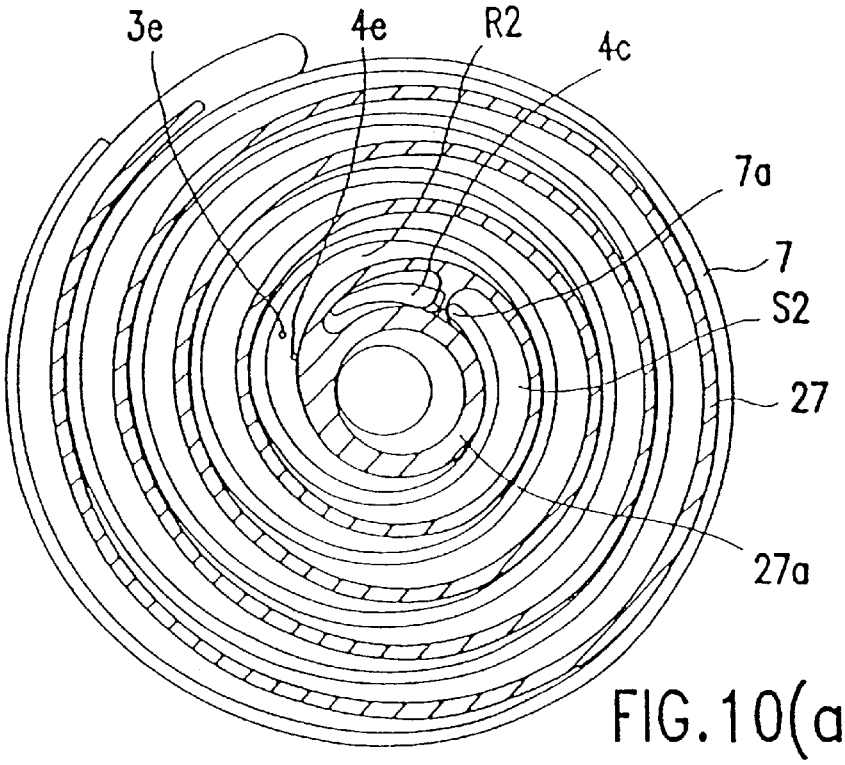
FIGS. 10(*a*) and 10(*b*) are schematic views showing a scroll state during the gas ballast gas introduction.
Figure 10B:
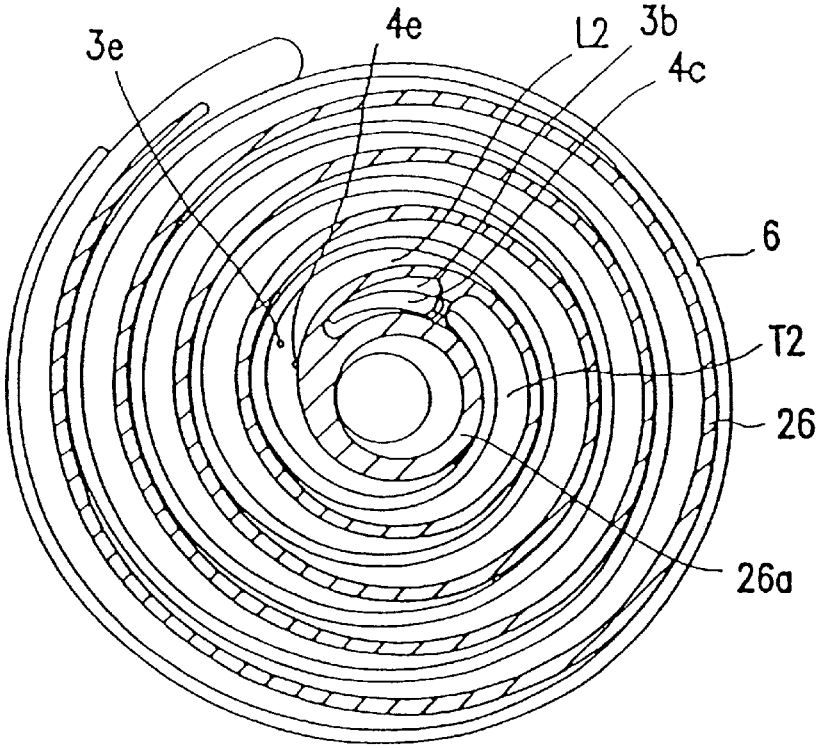
Figure 11A:
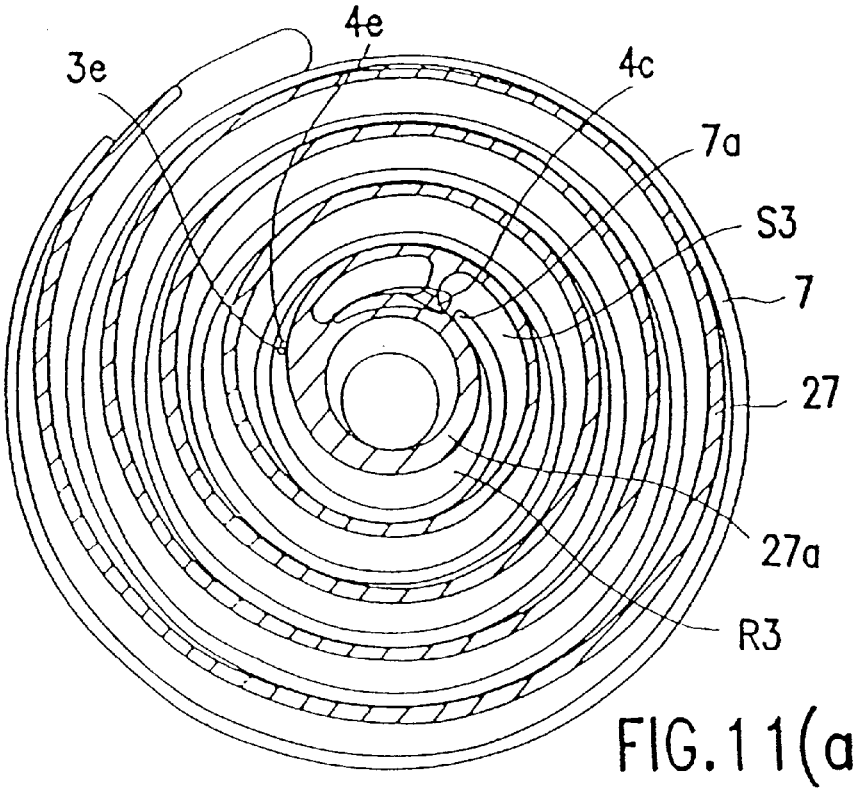
FIGS. 11(*a*) and 11(*b*) are schematic views showing a scroll state immediately before the end of the gas ballast gas introduction.
Figure 11B:
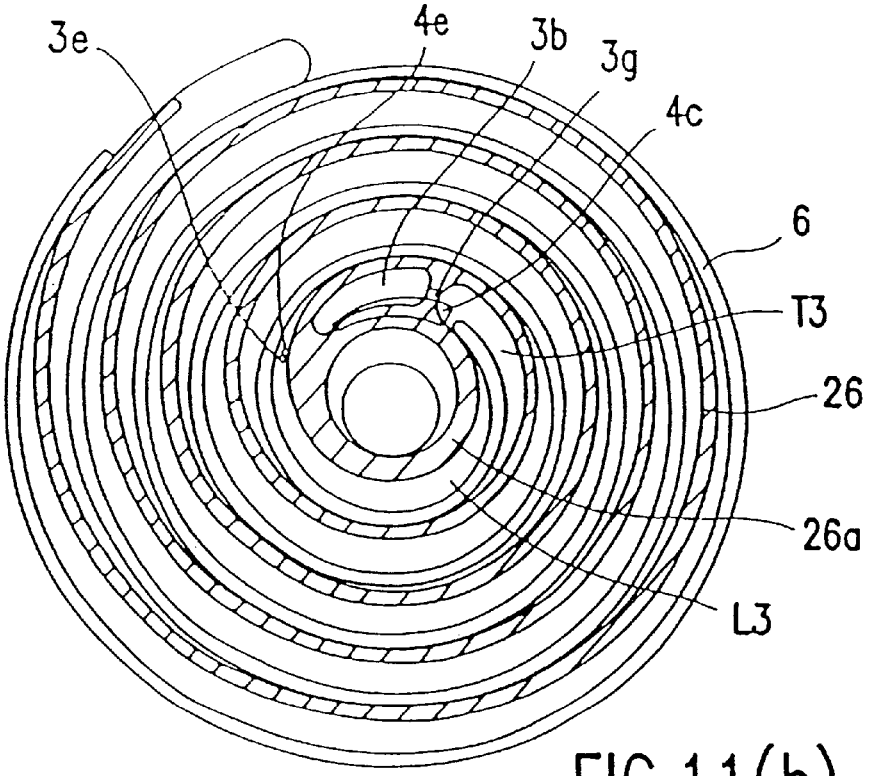

At this time, the steam content in the introduced gas or fluid is reduced. The fluid containing the steam is compressed through the states R2 and L2 (FIGS. 10) up to the states R3 and L3 (FIGS. 11).

The pressure of the compressed fluid in the sealed spaces R3 and L3 at this moment is higher than the gas ballast gas pressure. However, since the stationary scroll suction hole 49 is small in diameter while the revolving is driven at a high speed and gas ballast gas is resent in the suction hole, only slight compressed gas flows reversely through the suction hole 4*e*. Besides, the suction hole 4*e* is closed by the wrap end 27*a* of the revolving scroll 3 right before the sealed spaces R4 and L4 (FIGS. 12) are communicated with the discharge hole 4*c*.

When the sealed spaces R4 and L4 are communicated to the discharge hole 4*c* (FIGS. 12), the partial pressure of steam is reduced and becomes lower than the saturation vapor pressure in the scroll fluid machine. The steam thus is not liquified while liquefying water drops having been attached to the wrap surfaces after the condensation and liquefaction of steam noted above, and the overall steam is discharged through the discharge hole 4*c*.

Figure 9A:
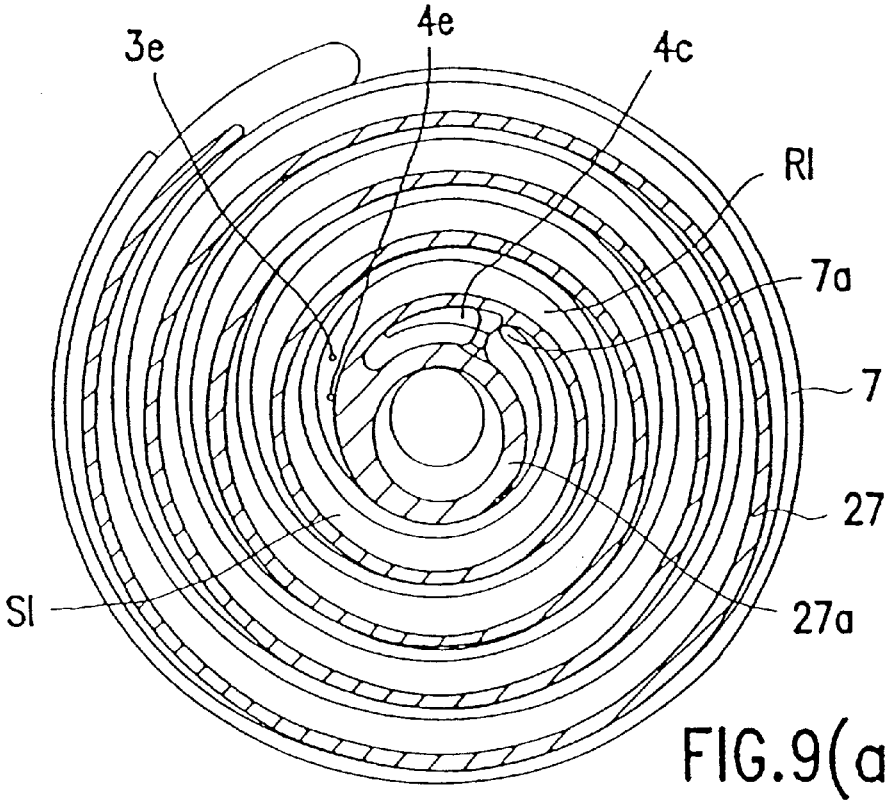
FIGS. 9(*a*) and 9(*b*) are schematic views showing a scroll state at the commencement of gas ballast gas introduction.
Figure 9B:
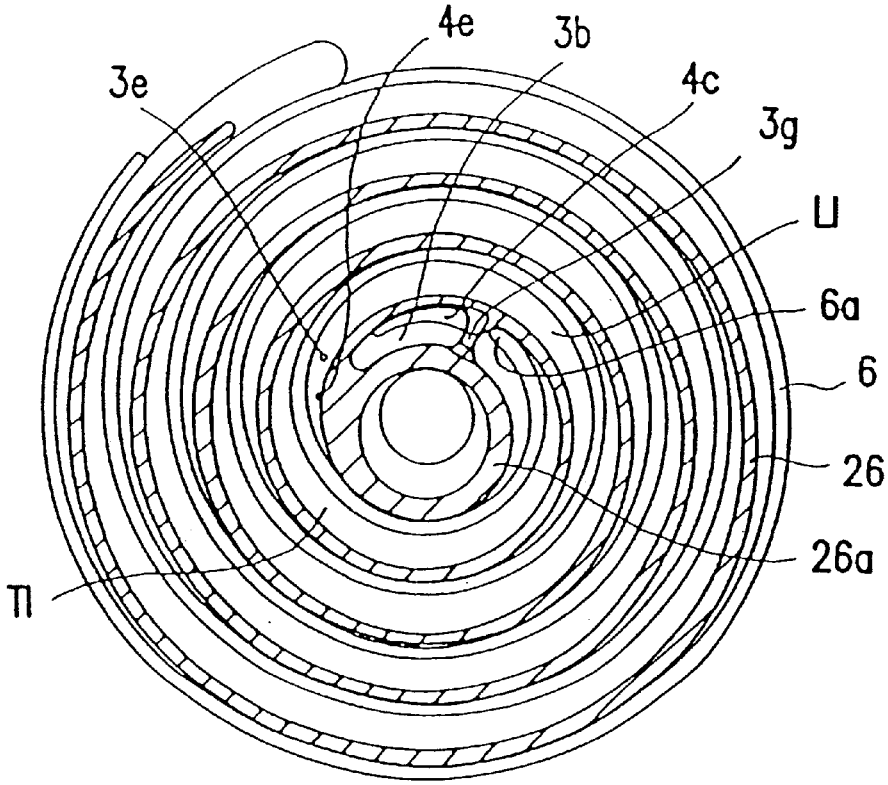
Figure 12A:
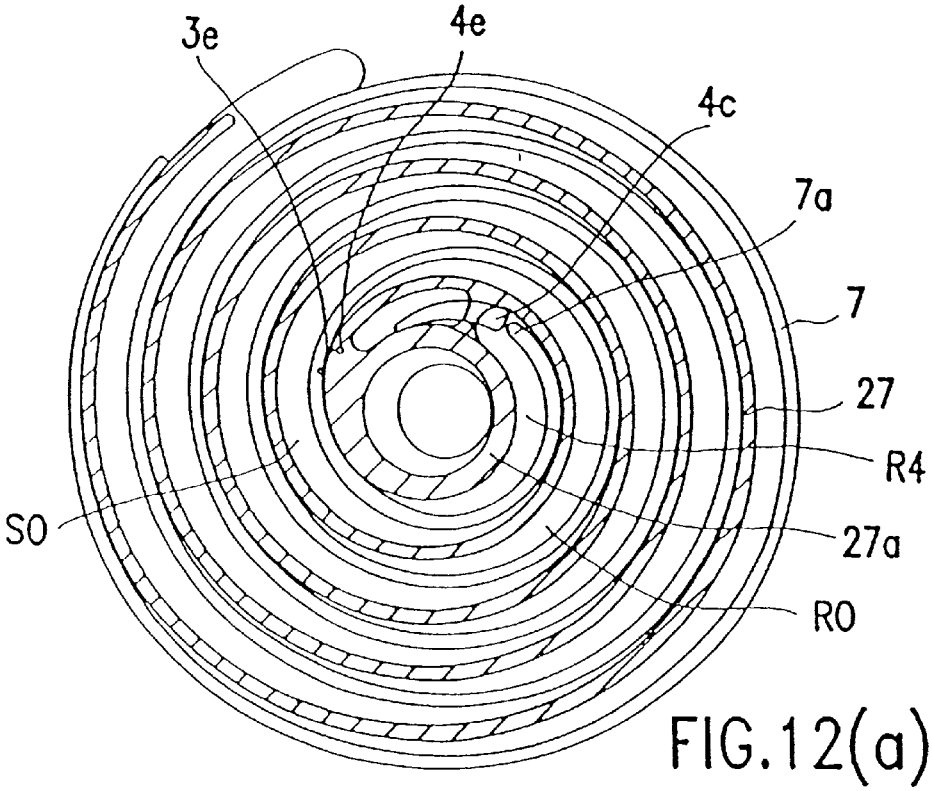
FIGS. 12(*a*) and 12(*b*) are schematic views showing a scroll state when a gas ballast gas suction hole is closed.
Figure 12B:
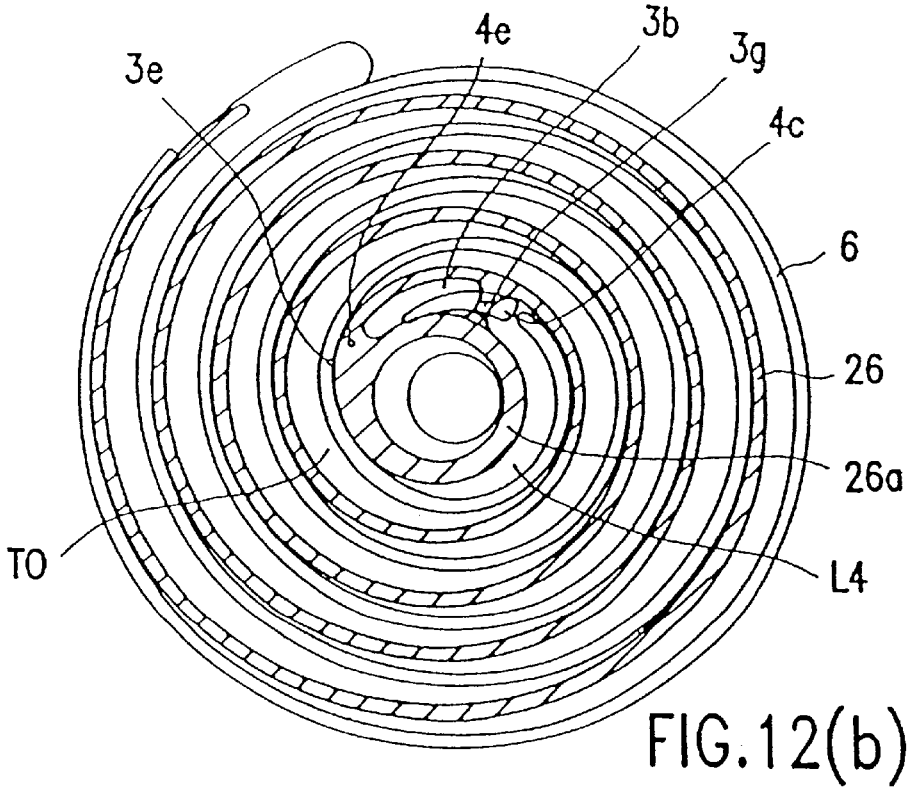

With rotation of the shaft 11 by 90° spaces S0 (a) and T0 (b) shown in FIGS. 12(*a*) and 12(*b*) are compressed to states S1(a) and T1(b) as shown in FIGS. 9(*a*) and 9(*b*). The spaces S1(a) and T1(b) are not communicated with the gas ballast suction hole. These spaces are changed to states S2 and T2 as shown in FIGS. 10(*a*) and 10(*b*) and then to states S3 and T3 as shown in FIGS. 11(*a*) and 11(*b*), which are communicated with the discharge hole 4*c*, whereupon the compressed gas is discharged to the outside. In this stroke, the saturation vapor pressure may be exceeded, resulting in condensation and liquefaction of steam, and water drops produced are attached to and accumulated on the wrap inner surfaces defining the final sealed spaces.

In this case, subsequent to the discharging of the compressed fluid from the sealed spaces S3 and T3 through the discharge hole 4*c*, the spaces R4 and L4 (as shown FIG. 12) which are in communication with the gas ballast suction pipe are communicated with the discharge hole 4*c*. Thus, compressed gas containing steam under a low partial pressure, lower than the saturation vapor pressure in the scroll fluid machine, is discharged through the discharge hole 4*e* while liquefying water drops produced as a result of condensation and liquefaction in the spaces S3 and T3.

The scroll fluid machine operating as described above, continuously compresses fluid sucked from its periphery as the fluid is led toward its central part. That is, the fluid is compressed utmost in the central part, which is thus elevated to the highest temperature.

Cooling means for cooling the central part of the apparatus will now be described.

Figure 1:
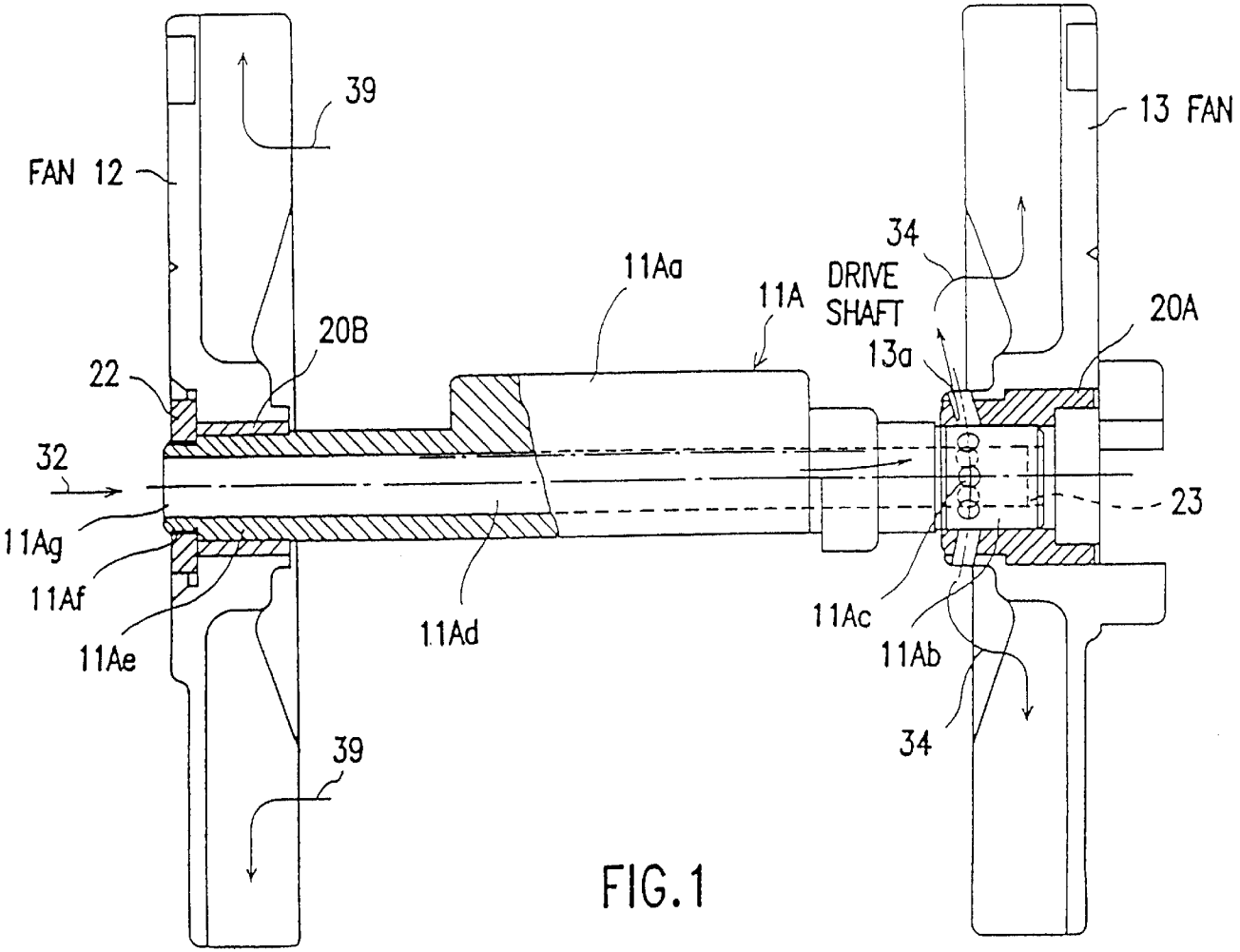
FIG. 1 is a view showing the shaft/fan assembly in a first embodiment of the scroll fluid machine according to the invention.

FIG. 1 shows cooling means, i.e., a shaft/fan assembly, in a first embodiment of the scroll fluid machine according to the invention. Referring to the figure, a drive shaft 11A has a cooling passage 11A*d* formed in it along its axis of rotation for introducing outer gas from a left open end 11A*g*. The right end of the cooling passage 11A*d* is shielded by a shield 23.

The drive shaft 11A has a plurality of radially spaced-apart holes 11A*c* formed adjacent its right end 11A*b* and communicating the cooling passage 11A*d* and its outside. A fan 13 is provided on the drive shaft 11A, that is, its boss 20A is fitted on and secured to the right end 11A*b* of the drive shaft 11A. The boss 20A has holes 13*a* in communication with the holes 11A*c*. The fan 13 thus can exhaust cooling gas having cooled the cooling passage 11A*d* through the holes 13*a* to the outside as shown by arrows 34.

Another fan 12 is provided on the left end 11A*e* of the drive shaft 11A with its boss 20B secured thereto by a nut 22 screwed on a threaded end portion 11A*f* of the drive shaft 11A. The fan 12 can exhaust cooling gas, which has been led through holes 29B*a* in a shield 29B (FIG. 7) and cooled the housing part 5 (FIG. 5) on the side thereof opposite the rap, to the outside as shown by arrows 39.

Figure 6:
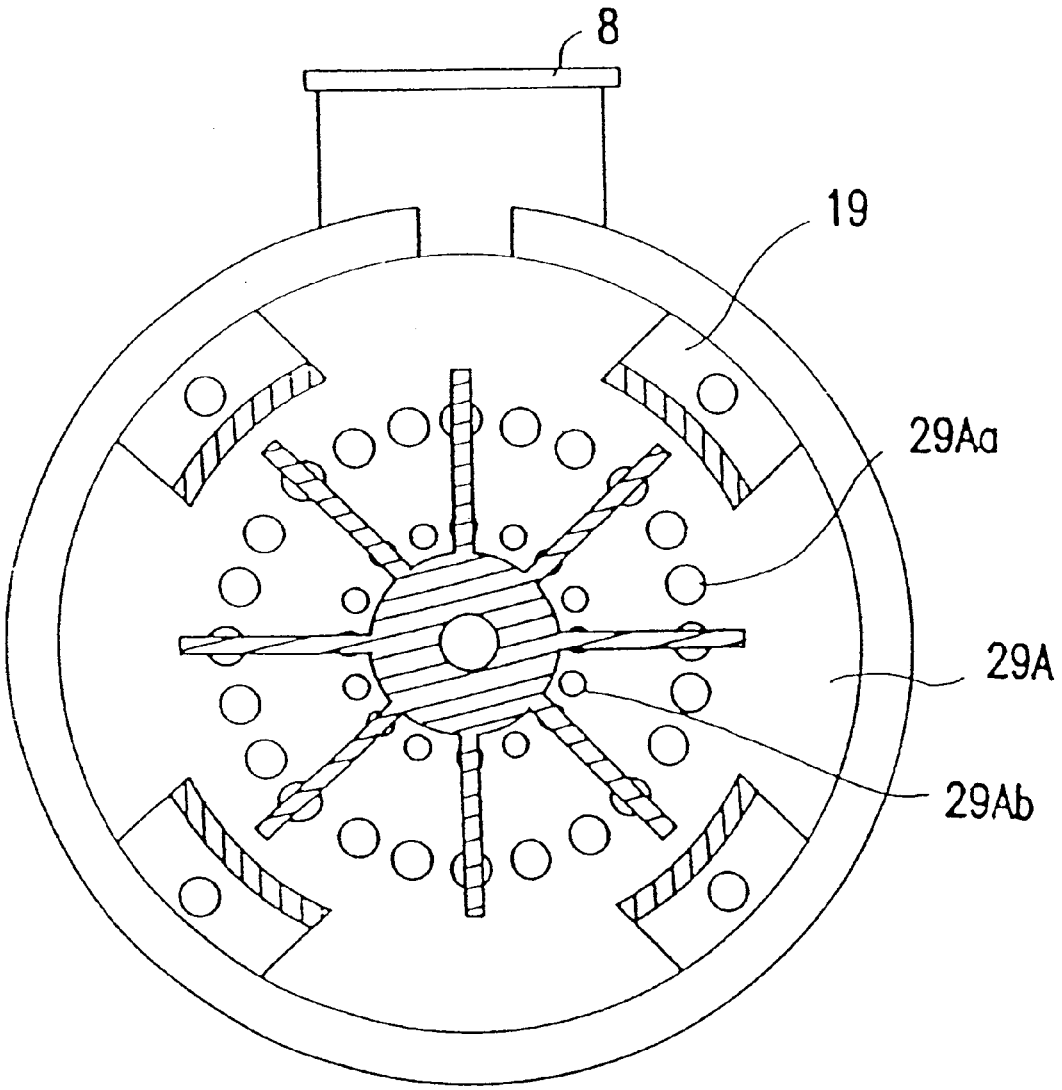
FIG. 6 is a view taken along line 6—6 in FIG. 5.
Figure 7:
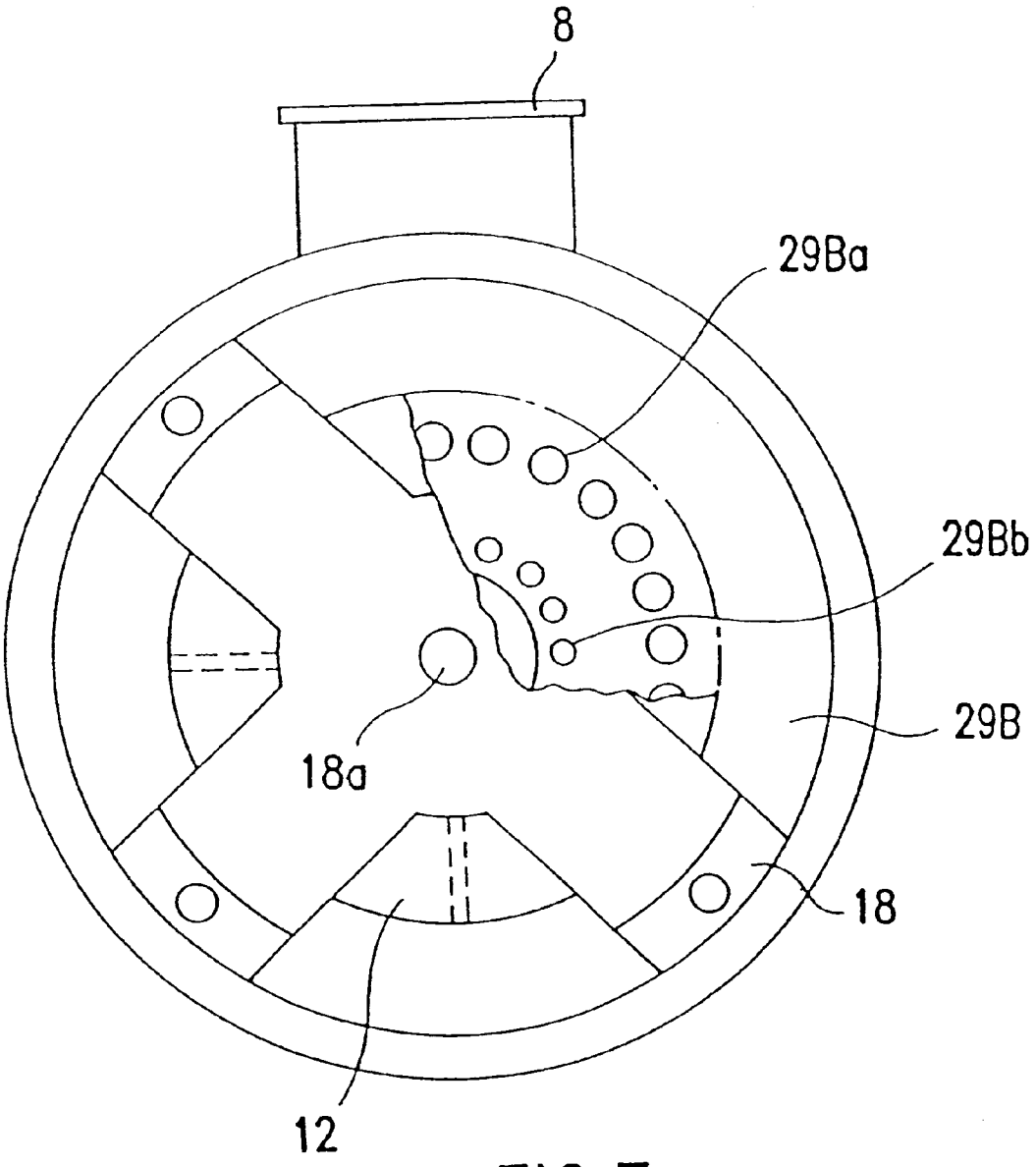
FIG. 7 is a view taken along line 7—7 in FIG. 5.

With this construction, a central part of the revolving scroll 3 is cooled by cooling gas 32 passing through the cooling passage 11Ad, and the gas having contributed to the cooling is exhausted by the fan 13 through the communication holes 11A*c* and the holes 29A*b* in the shield 29A (FIG. 6).

Figure 2:
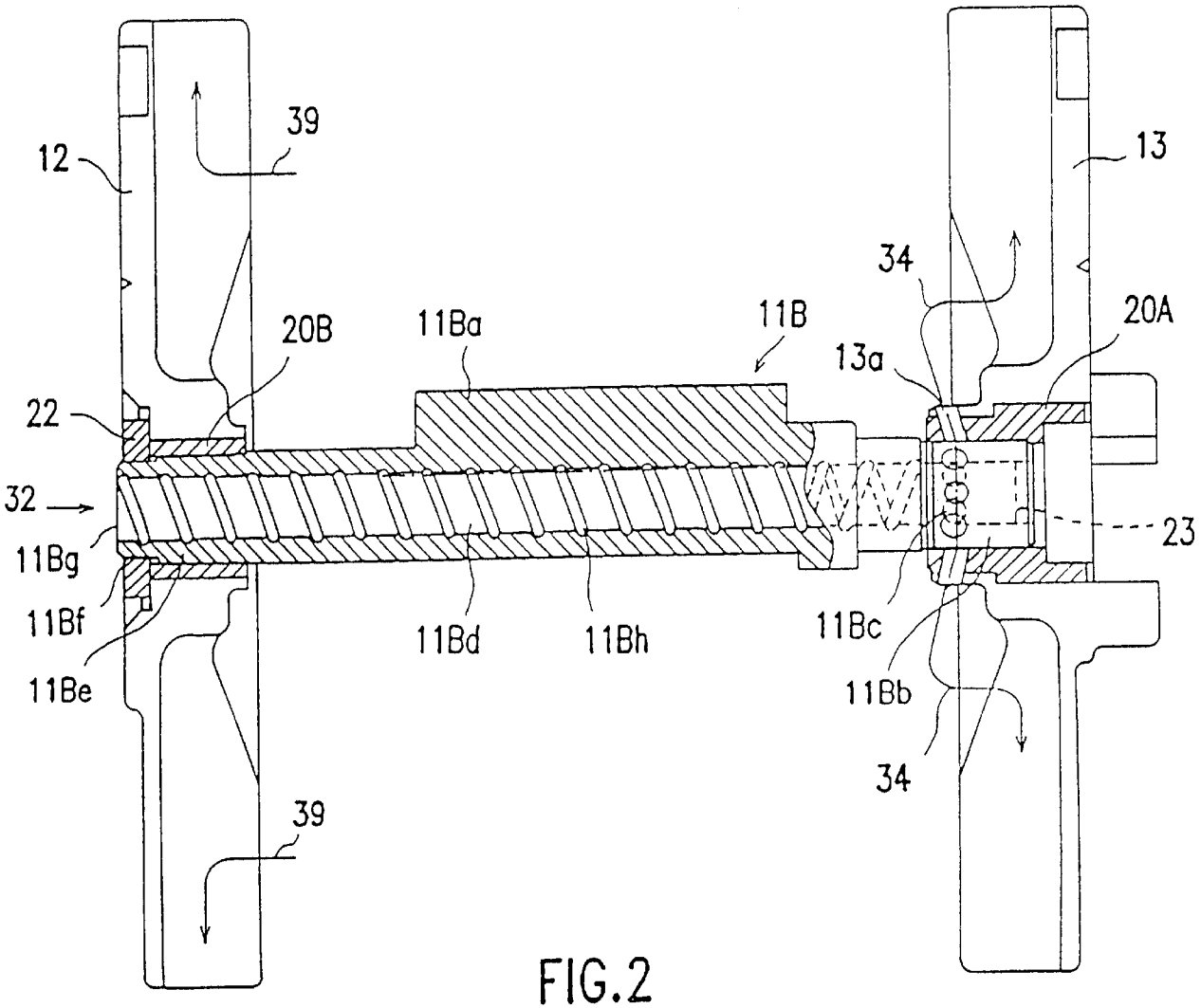
FIG. 2 is a view showing the shaft/fan assembly in a second embodiment of the scroll fluid machine according to the invention.

FIG. 2 is a view showing a shaft/fan assembly in a second embodiment of the scroll fluid machine according to the invention.

Referring to the figure, a drive shaft 11B has a cooling passage 11B*d* formed in it along its axis of rotation for introducing external gas from a left open end 11B*g*. A helical groove 11B*h* is formed in the inner surface of the passage 11B*d*. The right end of the passage 11B*d* is shielded by a shield 23.

The drive shaft 11B has a plurality of radially spaced-apart holes 11B*c* formed adjacent its right end 11B*b* and communicating the cooling passage 11B*d* and its outside. A fan 13 is provided on the drive shaft 11B with its boss 20A fitted on and secured to the right end 11Bb of the drive shaft 11B, the boss 20A having a plurality of radially spaced-apart holes 13*a*. Cooling gas having cooled the cooling passage 11B*d* is exhausted by the fan 13 through the holes 13*a* to the outside as shown by arrows 34.

Another fan 12 is provided on the left end 11B*e* of the drive shaft 11B with its boss 20B secured thereto by a nut 22 screwed on a threaded end portion 11B*f* of the drive shaft 11B. The fan 12 exhausts cooling gas having cooled the housing part (FIG. 5) on the side thereof opposite the wrap through holes 29B*a* formed in a shield 29B (FIG. 7) to the outside as shown by arrows 39.

With this construction, a central part of the revolving scroll 3 is cooled by cooling gas 32 passing through the passage 11B*d*. At this time, the helical groove 11B*h* functions as turbulent flow forming means to stir the introduced cooling gas, thus quickly reducing the gas temperature difference between an edge part of the cooling passage adjacent the surface thereof and a central part of the passage. Thus, efficient cooling can be obtained.

It is possible to form the turbulent flow forming means by inserting a helical coil spring in the cooling passage 11B*d* as well.

It is further possible to insert a mixing pipe, which has an outer diameter equal to the inner diameter of the cooling passage 11B*d* and mixes together two fluids, in the cooling passage 11B*d*.

Figure 3:
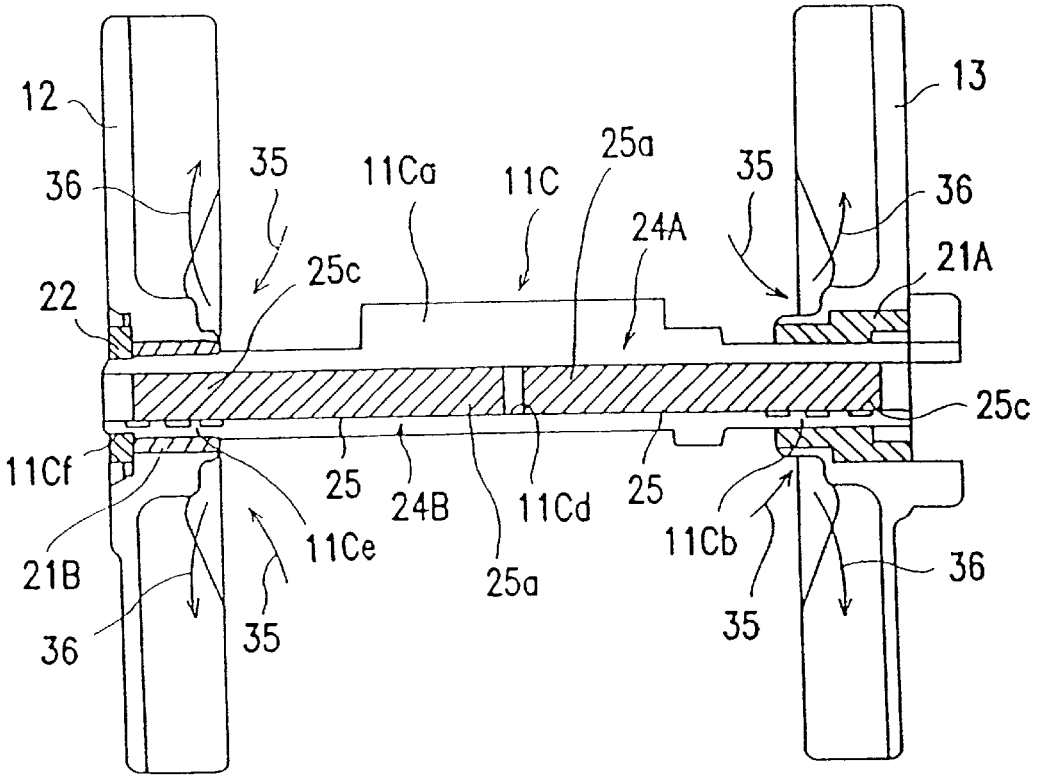
FIG. 3 is a view showing a shaft/fan assembly in a third embodiment of the scroll fluid machine according to the invention.

FIG. 3 is a view showing a shaft/fan assembly in a third embodiment of the scroll fluid machine according to the invention. Referring to the figure, a drive shaft 11C has a passage formed in it along its axis of rotation, and heat pipes 24A and 24B are disposed in the passage 11C*d*.

A fan 13 is provided on the drive shaft 11C with its boss 21A fitted on and secured to the right end 11C*b* of the drive shaft 11C. The fan 13 can exhaust cooling gas having cooled heat radiating zones 25*c* of the heat pipes 24A and 24B to the outside as shown by arrows 36.

Another fan 12 is provided on the left end 11C*e* of the drive shaft 11*e* with its boss 21B secured thereto by a nut 22 screwed on a threaded end portion 11C*b* of the drive shaft 11C. The fan 12 exhausts cooling gas having cooled heat radiating zone 25*c* of the heat pipe 24B to the outside as shown by arrows 36.

Figure 4:
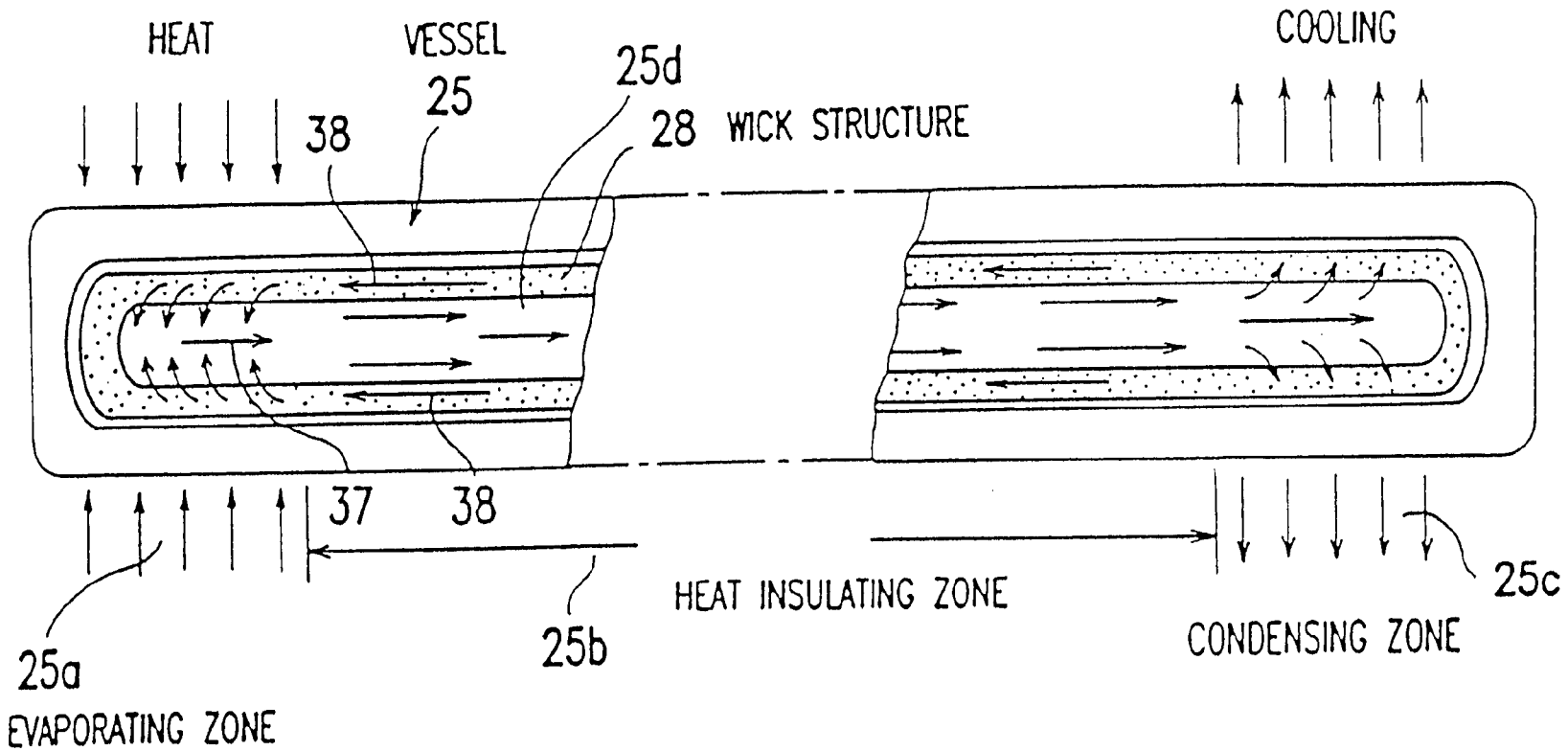
FIG. 4 is a view showing a heat pipe.

FIG. 4 shows either heat pipe 24A or 24B in detail. As shown, the heat pipe has a sealed pipe-like vessel 25 made of copper, stainless steel, nickel, tungsten, molybdenum or like material, a wick structure 28 disposed in the vessel 25, an inner space 25*d* defined in the wick structure 28 and operating fluid re-circulated between the wick structure 28 and the inner space 25*d* while being gasified and liquified by being heated and cooled. in an evaporating zone 25*a*, the operating fluid is gasified by receiving heat from a central part of the revolving scroll 3. The gasified operating fluid moves to a condensing zone (or heat radiating zone) 25*c* as shown by arrows 37, and in the condensing zone 25*c* it is liquified again by radiating heat to return to the wick structure 28.

Referring back to FIG. 3, with the above construction of the drive shaft 11C in the third embodiment having the heat pipes 24A and 24B disposed in the passage 11C*d*, the heating zones (or evaporating zones) 25*a* in the vessels 25 of the heat pipes 24A and 242 absorb heat generated in the revolving scroll 3 to cause evaporation and liquefaction of the operating fluid in the heat pipes, and the gasified fluid is cooled and liquified in the condensing zones 25*c* by external gas sucked by the fans 12 and 13 as shown by arrows 35.

The gas having contributed to the cooling is exhausted through the holes 29A*b* and 29B*b* in the shields 29A and 29B (FIGS. 6 and 7) to the outside as shown by arrows 36.

Figure 8:
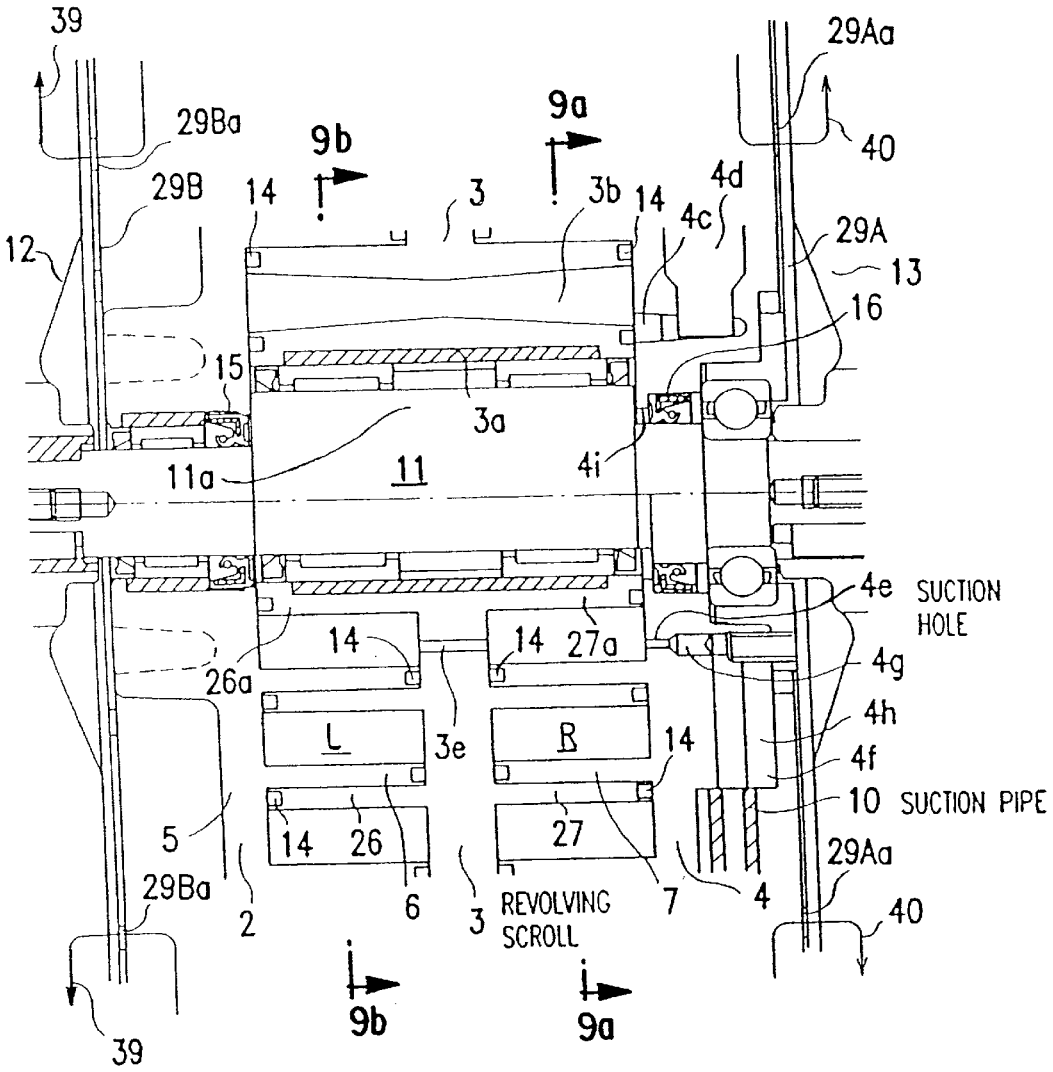
FIG. 8 is an enlarged-scale view showing a portion shown in FIG. 1.

The gas having cooled the housing parts 4 and 5 on the side thereof opposite the stationary scroll wraps is exhausted through the holes 29A*a* and 29B*a* in the shields 29A and 29B (FIGS. 6 and 7) and together with gas having cooled the central part of the revolving scroll 3 to the outside as shown by arrows 39 and 40 (FIG. 8).

The heat pipes 24A and 24B can transfer heat a great 30 deal, specifically several hundred times compared to such good heat conductor metals as copper and aluminum. It is thus possible to cool the central part of the revolving scroll efficiently.

Besides, the heat pipes are light in weight because they each are hollow and only have the wick structure defining the inner space filled with the operating fluid, while permitting very quick transfer of heat from locality remote from the source of heat and even with a small temperature difference. Efficient cooling of revolving scroll central part thus can be obtained.

It is further possible to easily set the heat transfer capacity by adequately designing the heat insulating zone 25*b* and appropriately designing the size and shape of the evaporating and condensing zones 25*a* and 25*c*.

Figure 13:
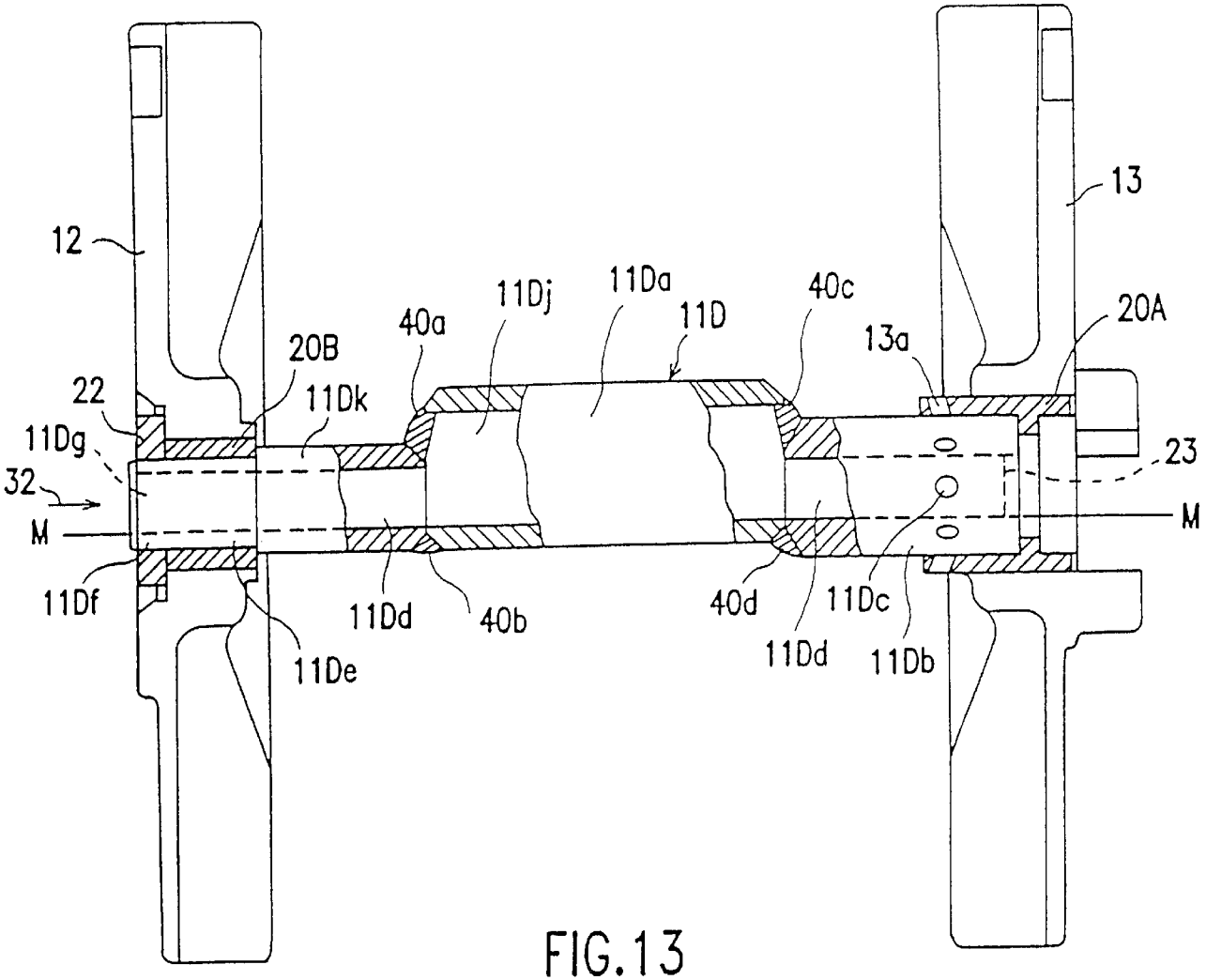
FIG. 13 is a view showing a modification of the shaft/fan assembly in the first embodiment of the scroll fluid machine according to the invention.

FIG. 13 is a view showing a modification of the shaft/fan assembly in the first embodiment of the scroll fluid machine of FIG. 1 according to the invention. In this case, a drive shaft 11D into which cooling gas is introduced, comprises a small diameter cylindrical part 11D*k*, a large diameter eccentric cylindrical part 11D*a*, and a medium diameter cylindrical part 11D*b*. The small and medium diameter parts 11D*k* and 11D*b* each have a cooling passage 11D*d* of an equal diameter, and the large diameter eccentric part 11D*a* has a cooling passage 11D*j* of a greater diameter and is provided between two cooling passages 11D*d* of left and right sides. These parts 11D*k*, left side 11D*d*, 11D*j* and right side 11D*d* are interconnected to one another in the mentioned order along line M—M on the inner peripheral surface of 11D*a* and 11D*j* by solders having 40*a*, 40*b*, 40*c* and 40*d* provided between adjacent ends of them.

With this construction, when the drive shaft 11D, i.e., the passage 11D*j* in the eccentric part 11D*a*, is rotated, cooling gas introduced into the cooling passage 11D*d* is spread in the passage 11D*j* in the eccentric part 11D*a* and is pushed by the inner peripheral surface of the passage 11D*j*, thus generating a turbulent flow. Thus, efficient heat exchange can be obtained.

Figure 14:
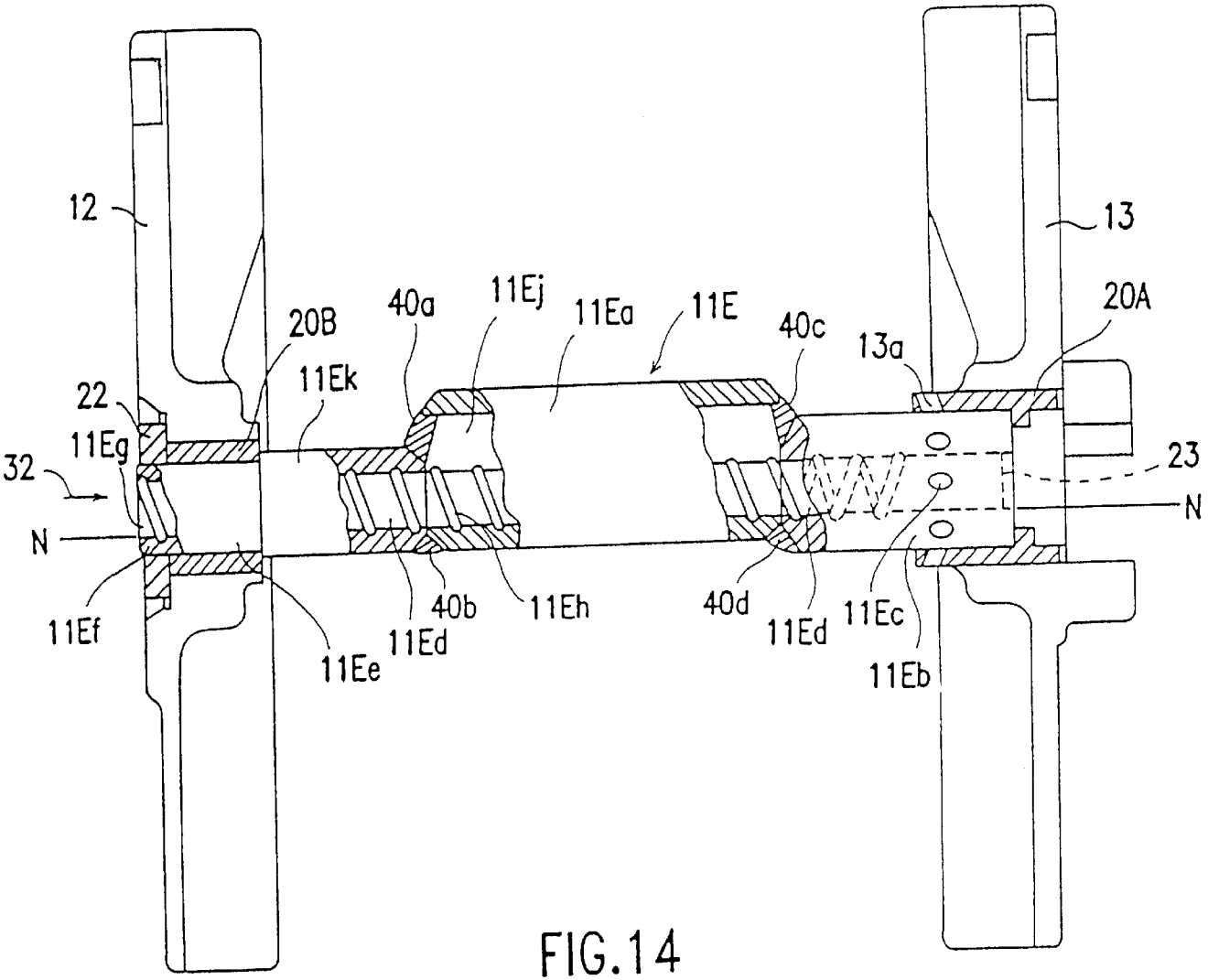
FIG. 14 is a view showing a modification of the shaft/fan assembly in the second embodiment of the scroll fluid machine according to the invention.

FIG. 14 is a view showing a modification of the shaft/fan assembly in the second embodiment of the scroll fluid machine according to the invention. In this case, a drive shaft 11E into which cooling gas is introduced, comprises a small diameter cylindrical part 11E*k*, a large diameter eccentric cylindrical part 11E*a*, and a medium diameter cylindrical part 11E*b*, these parts 11E*k*, 11E*a* and 11E*b* being interconnected along line N—N by solders 40*a* to 40*d* provided between adjacent ends of them. The small and medium diameter parts 11E*k* and 11E*b* each have a cooling passage 11E*d* of an equal diameter, and the large diameter eccentric part 11E*a* has a passage 11E*j* of a greater diameter. A helical groove 11E*h* is formed in the inner surfaces of the passages 11E*d*.

With this construction, when the drive shaft 11E is rotated, the helical groove 11E*d* forms a turbulent flow of cooling gas introduced into the cooling passage 11E*d*. Further, with the rotation of the passage 11E*j* of the eccentric part 11E*a* the cooling gas is spread therein and pushed by the inner peripheral surface of this passage lIE*j*, thus promoting the turbulent flow and permitting more efficient heat exchange.

As described before in connection with the second embodiment, it is possible to replace this turbulent flow forming means with a helical coil spring inserted in the passages 11E*d* and 11E*j*. As a further alternative, a mixing pipe having an outer diameter equal to the inner diameter of the cooling passages 11E*d* for mixing two different fluids may be inserted in the passages 11E*d*.

Figure 15:
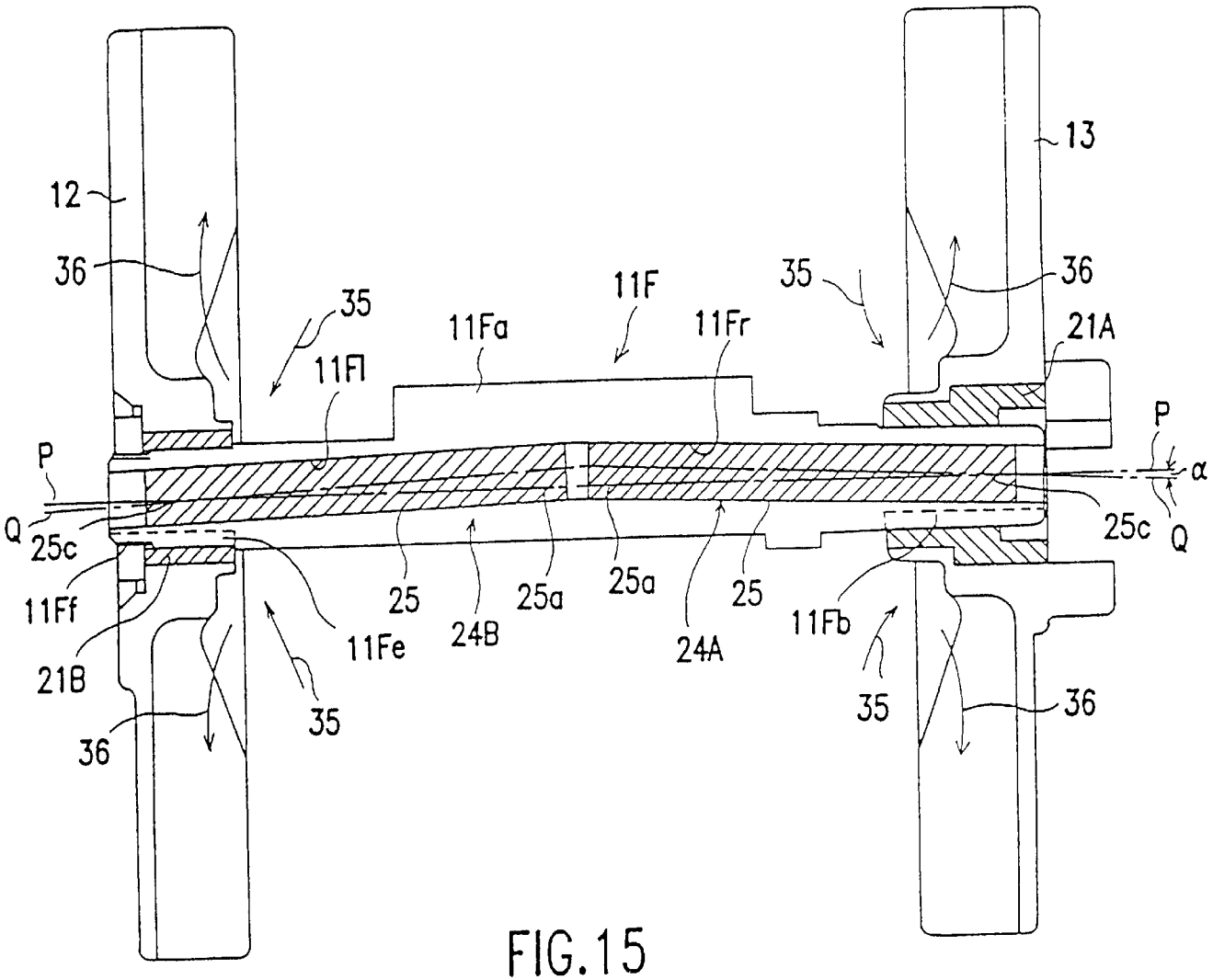
FIG. 15 is a view showing a modification of the shaft/fan assembly in the third embodiment of the scroll fluid machine according to the invention.
Figure 16:
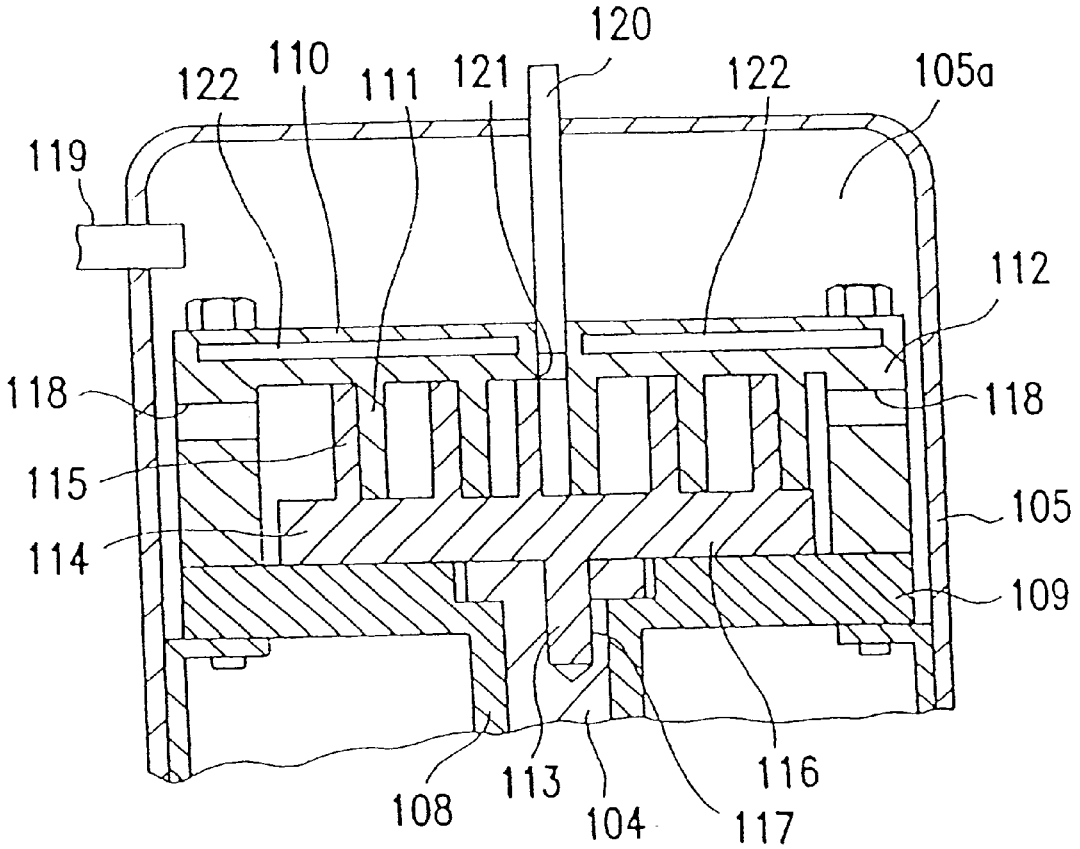
FIG.16 PRIOR ART
FIG. 16 is a view showing a prior art non-driven part cooling system.
Figure 17:
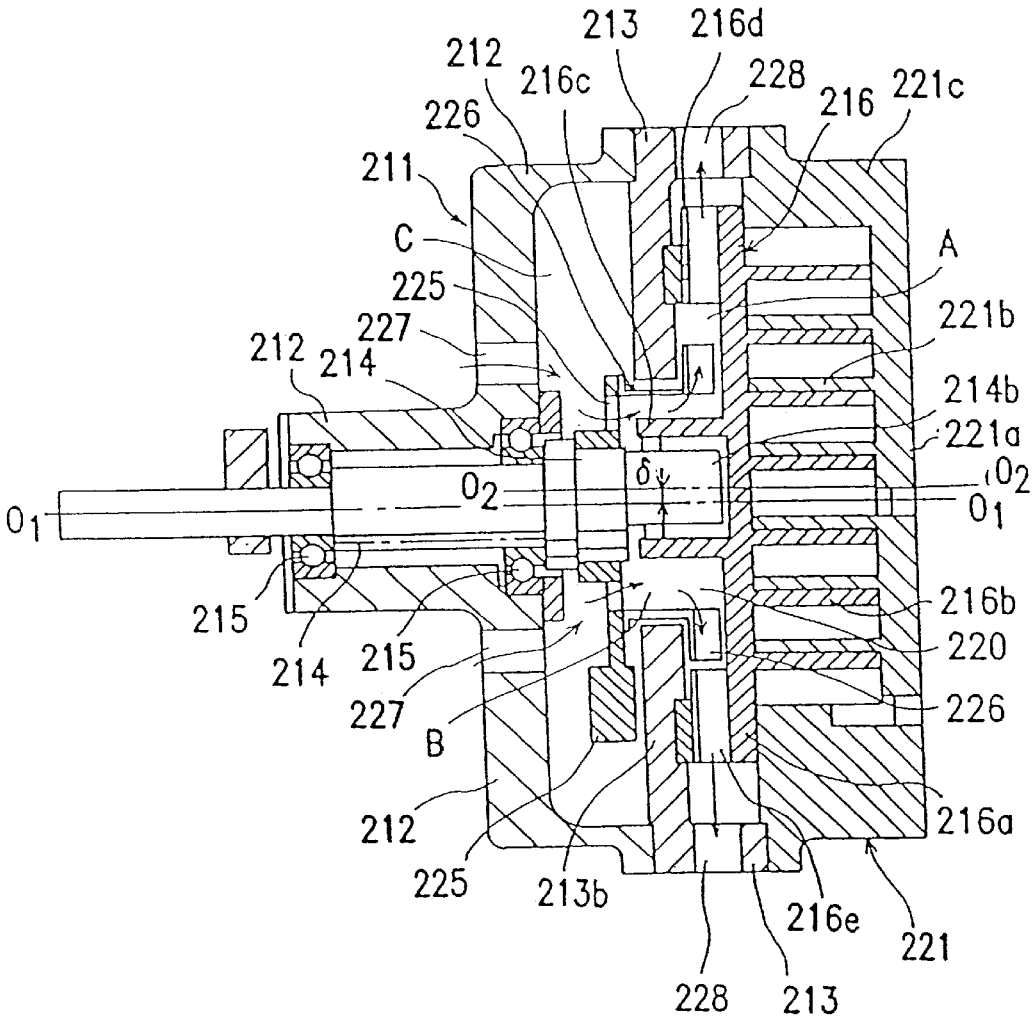
FIG.17 PRIOR ART
FIG. 17 is a view showing a prior art driven part cooling system.

FIG. 15 shows a modification of the shaft/fan assembly in the third embodiment of the scroll fluid machine according to the invention. In this case, a drive shaft 11F has passages 11F*r* and 11F*l* formed in it at an angle a inclination with respect to its axis P of rotation from its opposite ends toward its eccentric portion 11F*a*. Heat pipes 24A and 24B are disposed in the passages 11F*r* and 11F1. A fan 13 is provided on the drive shaft 11F with its boss 21A fitted on and secured to the right end11F*b* of the drive shaft 11F. The fan 13 can exhaust cooling gas having cooled a heat radiating zone 25*c* of the heat pipe 24A to the outside as shown by arrows 36.

Another fan 12 is provided on the left end11F*e* of the drive shaft 11F with its boss 21E secured in position by screwing a nut 22 on a threaded end portion 11F*f* of the drive shaft 11F. The fan 12 can exhaust cooling gas having cooled a heat radiating zone 25*c* of the heat pipe 24B as shown by arrows 36.

With this modified construction, heat exchange is obtained by the operation as described above in connection with the third embodiment.

Specifically, the heat pipes 24A and 24B evaporate and gasify operating fluid in them by absorbing heat generated in the revolving scroll 3 from their heating zones (or evaporating zones) 25*a* in the vessels 25, and in their condensing zones 25*c* the gasified fluid is cooled and liquified by external gas sucked by the fans 12 and 13 as shown by arrows 35.

The external gas having contributed to the cooling is exhausted through the holes 29A*b* and 29B*b* in the shields 29A and 29B (FIGS. 6 and 7) to the outside as shown by arrow 36.

Gas which has cooled the housing parts 4 and 5 on the side thereof opposite the stationary scroll wraps is exhausted through the holes 29A*a* and 29B*a* of the shields 29A and 29B (FIGS. 6 and 7) together with the gas having cooled the central part of the revolving scroll to the outside as by arrows 39 and 40 (FIG. 8).

Since in this modification the passages 11F*r* and 11F*l* are inclined with respect to the drive shaft axis P, in the above heat exchange process the heating zones 25*a* revolve about the axis P to generate centrifugal forces forcing the operating fluid that is liquified in the condensing zones 25*c* to the heating zones 25*a*, thus promoting the re-circulation of the operating fluid and improving the cooling effect.

It will be seen that according to the invention it is possible to use heat pipes of rotary type utilizing centrifugal forces as well as heat pipes based on the operating fluid re-circulating system having capillary tube action type. Thus, a very wide range of heat pipes can be used.

The invention has so far been described in conjunction with the construction comprising the double-side revolving scroll with wraps embedded in the opposite side surfaces of the scroll body and the stationary scrolls as shown in FIG. 5. However, this is by no means limitative, and the invention is also applicable to a construction comprising a single wrap revolving scroll with a single wrap embedded in only one side surface of a scroll body and a single stationary scroll. In this case, either the stationary scroll or the revolving scroll is located near the fan noted above. The fan can of course exhaust gas having cooled the heat pipes and also the stationary or revolving scroll on the side thereof opposite the wrap.

In the above embodiments of the invention, the fan is provided at one end of the drive shaft, which has the radial communication holes formed adjacent the other end of the cooling passage for communication thereof toward the outer periphery of axis. The fan serves to compulsively exhaust gas having contributed to the cooling of the cooling passage through the communication holes, thus cooling the revolving scroll central part while also cooling other parts of the scroll fluid machine with gas not passing through the cooling passage.

Specifically, the central part of the revolving scroll 3 is cooled by cooling gas 32 passing through the cooling passage 11A*d* (FIG. 1) or 11B*d* (FIG. 2), while the gas having contributed to the cooling is compulsively exhausted by the fan 13 through the communication holes 11A*c* (FIG. 1) Or 11B*c* (FIG. 2).

The fan 13 further exhausts gas having cooled the rear side of the housing part 4 as the stationary scroll opposite the wrap side thereof as shown by arrows 40.

Thus, not only the revolving scroll central part but other scroll fluid machine parts can be cooled, thus improving the cooling efficiency.

As has been described in the foregoing, according to the invention the scroll fluid machine drive shaft, on which the central part of the revolving scroll is mounted, and which is coupled to the drive, can be cooled directly, that is, heat generated in the process, in which fluid sucked from the edge of the revolving scroll is fed to the central part thereof while being progressively compressed, can be removed at the central part which is elevated to the highest temperature. It is thus possible to efficiently cool bearings and seal members provided near the revolving scroll central part and the drive shaft.

In addition, the thermal expansion difference between the stationary and revolving scrolls can be eliminated to provide a uniform temperature distribution, prevent scoring of the wraps and extend the grease maintenance cycle, thus improving the durability.

Since heat generation can be reduced the clearance between adjacent scrolls can be reduced. Also, the high speed operation can be increased to increase the attainable pressure.

In the above embodiments, the wrap sliding surface of the revolving scroll is formed with the gas ballast suction hole, which has a smaller diameter than the thickness of the revolving scroll wraps so that it can be opened and closed by driving of above revolving scroll wrap, that is, closed above suction hole in synchronism to the instant when the final sealed spaces formed by the stationary and revolving scrolls are communicated with the discharge passage to the outside. More specifically, the gas ballast suction hole is closed while the final sealed spaces are communicated with the discharge passage. Thus, compressed fluid can be discharged through the discharge passage to the outside without possibility of its back flow through the suction hole.

Since the back flow of compressed fluid can be eliminated by a simple arrangement of setting the diameter of the suction hole to be smaller than the wrap thickness, it is not necessary to provide any particular check valve in the gas ballast suction hole.

In the above embodiments, which comprise the double side wrap revolving scroll with the wraps provided on the opposite sides and the first and second stationary wraps with the wraps thereof engaging with the respective revolving scroll wraps, the gas ballast suction hole is formed in one of the stationary scrolls, the communication hole is formed in the scroll body of the revolving scroll to lead gas to the sealed space formed by the wrap of the other stationary scroll and the associated revolving scroll wrap, and the discharge hole is formed in the aforementioned one stationary scroll, thereby discharging compressed gas from both the sealed spaces through the discharge hole to the outside. That is, the suction hole and the discharge hole are both formed in one of the stationary scrolls. In other words, those above two holes are provided concentrated on the side of the afore-mentioned one stationary scroll opposite the wrap side thereof. This construction is simple and ready to manufacture compared to the case of forming the holes distributed in the two stationary scrolls.

Moreover, since the communication hole formed in the scroll body of the revolving scroll leads gas, which is introduced through the gas ballast suction hole into the sealed space formed by one of the revolving scroll wraps and the wrap of one stationary scroll, to the sealed space formed by the other revolving scroll wrap and the wrap of the other stationary scroll, both the stationary scrolls need not be formed with a gas ballast suction hole. Only a single stationary scroll may be formed with a suction hole, thus simplifying the construction and manufacture.

The above embodiments can further be modified variously.

Introducing gas into the spaces R and L through the gas ballast suction hole as shown above is by no means limitative; it is possible to introduce gas ballast gas into the spaces S and T.

The suction pipe 10 and the discharge passage 4*c*, 4*d* may be provided on the side of the housing part 5 instead of providing them on the side of the housing part 4 (FIG. 8).

It is possible to provide ballast gas suction holes in both the housing parts 4 and 5 to introduce gas ballast gas into the spaces R and L formed by the revolving and stationary scrolls from both sides. With this case, it is not necessary to arrange a suction hole 3*e* which connects the space R with L. Thus, ballast gas can be introduced quickly from both sides, and the cooling efficiency is improved.

It is of course possible to provide a discharge passage the side of the housing part 5 as well as the discharge passage 4*c*, 4*d* on the side of the housing 4.

As the gas ballast gas, atmospheric gas may be introduced through the suction pipe 10. It is desirable to heat dry gas air, $N_2$ gas, etc. to be introduced. In this case, it is possible to hasten the drying of vapor or fluid in the scroll wrap and prevent deterioration.

Moreover, in the above embodiments it is possible to introduce $N_2$ gas or like diluting gas through the suction pipe to dilute any harmful gas sucked from a vessel to be evacuated in order to meet safety standards.

As has been shown, according to the invention cooling means having high cooling efficiency is used to prevent scoring of the wraps and extend the grease maintenance cycle for providing improved durability.

Also, by reducing the heat generation the clearance between adjacent scrolls can be reduced. Furthermore, the high speed operation can be increased to increase the attainable pressure.

What is claimed is:

1. A scroll fluid machine comprising:

a stationary scroll provided with a spiral wrap extending from a central part of a plate of the stationary scroll toward a perimeter thereof;

a revolving scroll with a spiral wrap provided on a plate of the revolving scroll, said spiral wrap engaging said spiral wrap of said stationary scroll; and a drive shaft, said revolving scroll supported on an offset portion of the drive shaft so as to be revolved with rotation of said drive shaft, said drive shaft having a longitudinal cooling passage formed therein, one end of said passage being open, another end of said passage being closed, cross bores being bored near said end of said passage which is closed so that cooling gas, introduced from said open end, flows out through said cross bores radially outwardly.

2. The scroll fluid machine according to claim 1, and further comprising a means for stirring cooling gas flow to effect turbulence provided in the cooling passage formed in the drive shaft, the cooling gas flowing out near the closed end of said cooling passage radially outwardly through the cross bores.

3. A scroll fluid machine comprising:

first and second stationary scrolls, each of said scrolls being provided with a spiral wrap extending from a central portion of a plate thereof toward a perimeter thereof;

a revolving scroll, said revolving scroll including a spiral wrap provided on each side of a plate of the revolving scroll, each spiral wrap engaging with the spiral wrap of one of said stationary scrolls; and a drive shaft, said revolving scroll supported on an offset portion of the drive shaft so as to be revolved with rotation of said drive shaft, said drive shaft having a longitudinal cooling passage formed therein, one end of said passage being open, another end of said passage being closed, cross bores being bored near said end of said passage which is closed so that cooling gas, introduced from said open end, flows out through said cross bores radially outwardly.

4. The scroll fluid machine according to claim 3, and further comprising a cooling fan provided at the closed end, wherein said fan introduces air from the perimeter of the plate of the stationary scroll adjacent to said fan and from the open end of the passage, said air from the perimeter flowing radially inwardly to a central portion of the plate of said stationary scroll, cooling a rear surface of said stationary scroll, and flowing out through said cooling fan together with the air introduced from the open end of the passage, flowing out from the cross bores at the closed end of the passage in the drive shaft radially outwardly, and sucked in by said cooling fan.

5. The scroll fluid machine according to claim 3, and further comprising a means for stirring cooling gas flow to effect turbulence provided in the cooling passage formed in the drive shaft, the cooling gas flowing out near the closed end of said cooling passage radially outwardly through the cross bores.

6. The scroll fluid machine according to claim 5, and further comprising a cooling fan provided at the closed end, wherein said fan introduces air from the perimeter of the plate of the stationary scroll adjacent to said fan and from the open end of the passage, said air from the perimeter flowing radially inwardly to a central portion of the plate of said stationary scroll, cooling a rear surface of said stationary scroll, and flowing out through said cooling fan together with the air introduced from the open end of the passage, flowing out from the cross bores at the closed end of the passage in the drive shaft radially outwardly, and sucked in by said cooling fan.

* * * * *